US007139689B2

(12) United States Patent
Huang

(10) Patent No.: US 7,139,689 B2
(45) **Date of Patent: *Nov. 21, 2006**

(54) SIMULATING THE DYNAMIC RESPONSE OF A DRILLING TOOL ASSEMBLY AND ITS APPLICATION TO DRILLING TOOL ASSEMBLY DESIGN OPTIMIZATION AND DRILLING PERFORMANCE OPTIMIZATION

(75) Inventor: Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 318 days.

This patent is subject to a terminal disclaimer.

(21) Appl. No.: 10/852,574

(22) Filed: May 24, 2004

(65) Prior Publication Data

US 2004/0211596 A1 Oct. 28, 2004

(51) Int. Cl.
*G06G 7/62* (2006.01)

(52) U.S. Cl. ..... 703/7; 175/45; 702/9

(58) Field of Classification Search ..... 703/7; 175/45, 50; 702/6, 9
See application file for complete search history.

(56) References Cited

U.S. PATENT DOCUMENTS

| | | | |
|---|---|---|---|
| 1,209,299 | A | 12/1916 | Hughes |
| 1,263,802 | A | 4/1918 | Reed |
| 1,394,769 | A | 10/1921 | Sorensen |
| 4,408,671 | A | 10/1983 | Munson |
| 4,475,606 | A | 10/1984 | Crow |
| 4,815,342 | A | 3/1989 | Brett et al. |
| 4,862,974 | A | 9/1989 | Warren |
| 4,932,484 | A | 6/1990 | Warren |
| 4,982,802 | A | 1/1991 | Brett |
| 5,010,789 | A | 4/1991 | Brett |
| 5,042,596 | A | 8/1991 | Brett |
| 5,131,478 | A | 7/1992 | Brett |
| 5,178,222 | A | 1/1993 | Jones |
| RE34,435 | E | 11/1993 | Warren et al. |
| 5,456,141 | A | 10/1995 | Ho |
| 5,605,198 | A | 2/1997 | Tibbitts |
| 5,613,093 | A | 3/1997 | Kolb |
| 5,787,022 | A | 7/1998 | Tibbitts et al. |
| 5,794,720 | A | 8/1998 | Smith et al. |
| 5,803,196 | A | 9/1998 | Fielder |
| 5,864,058 | A | 1/1999 | Chen |
| 5,868,213 | A | 2/1999 | Cisneros et al. |
| 5,903,743 | A | 5/1999 | Kolb |

(Continued)

FOREIGN PATENT DOCUMENTS

BE 1013217 A6 10/2001

(Continued)

OTHER PUBLICATIONS

Certification and Notarization dated Nov. 12, 2003 from Universe Technical Translation for English Translations of SU-933932; SU-295857; SU-398733; SU-420749; SU-420749; SU-229371; SU-436147; and SU-515867 (1 page).

(Continued)

*Primary Examiner*—Albert W. Paladini
(74) *Attorney, Agent, or Firm*—Osha Liang LLP

(57) ABSTRACT

A method for simulating a drilling tool assembly having a drill string and a drill bit. The method includes simulating a dynamic response of the drill string; simulating a dynamic response of the drill bit; and resolving the dynamic response of the drill string and the dynamic response of the drill bit into a dynamic response of the drilling tool assembly.

8 Claims, 15 Drawing Sheets

U.S. PATENT DOCUMENTS

| | | | | |
|---|---|---|---|---|
| 5,950,747 | A | 9/1999 | Tibbitts et al. | |
| 6,021,377 | A | 2/2000 | Dubinsky et al. | |
| 6,021,859 | A | 2/2000 | Tibbitts | |
| 6,095,262 | A | 8/2000 | Chen | |
| 6,109,368 | A | 8/2000 | Goldman et al. | |
| 6,131,673 | A | 10/2000 | Goldman et al. | |
| 6,213,225 | B1 | 4/2001 | Chen | |
| 6,241,034 | B1 | 6/2001 | Steinke et al. | |
| 6,269,893 | B1 | 8/2001 | Beaton | |
| 6,290,006 | B1 | 9/2001 | Crawford | |
| 6,298,930 | B1 | 10/2001 | Sinor | |
| 6,349,595 | B1 | 2/2002 | Civolani et al. | |
| 6,374,926 | B1 | 4/2002 | Goldman et al. | |
| 6,401,839 | B1 | 6/2002 | Chen | |
| 6,408,953 | B1 | 6/2002 | Goldman et al. | |
| 6,412,577 | B1 | 7/2002 | Chen | |
| 6,435,058 | B1 | 8/2002 | Matthias | |
| 6,516,293 | B1 | 2/2003 | Huang et al. | |
| 6,536,543 | B1 | 3/2003 | Meiners | |
| 6,612,382 | B1 | 9/2003 | King | |
| 6,695,073 | B1 | 2/2004 | Glass | |
| 6,711,969 | B1 | 3/2004 | Meiners | |
| 6,729,420 | B1 | 5/2004 | Mensa-Wilmot | |
| 6,785,641 | B1 * | 8/2004 | Huang | 703/7 |
| 6,873,947 | B1 | 3/2005 | Huang et al. | |
| 2001/0042642 | A1 | 11/2001 | King | |
| 2003/0015351 | A1 | 1/2003 | Goldman et al. | |
| 2003/0187582 | A1 | 10/2003 | Goldman et al. | |
| 2003/0196835 | A1 | 10/2003 | Singh et al. | |
| 2004/0000430 | A1 | 1/2004 | King | |
| 2004/0059554 | A1 | 3/2004 | Goldman et al. | |
| 2004/0143427 | A1 | 7/2004 | Huang | |
| 2004/0182606 | A1 | 9/2004 | Goldman et al. | |
| 2004/0211596 | A1 | 10/2004 | Huang | |
| 2005/0010382 | A1 | 1/2005 | Oliver | |
| 2005/0096847 | A1 | 5/2005 | Huang | |
| 2005/0133272 | A1 | 6/2005 | Huang | |
| 2005/0149306 | A1 | 7/2005 | King | |

FOREIGN PATENT DOCUMENTS

| | | | |
|---|---|---|---|
| EP | 0728912 | A2 | 8/1996 |
| EP | 0972908 | A2 | 1/2000 |
| EP | 1046781 | A1 | 10/2000 |
| EP | 1146200 | A1 | 10/2001 |
| GB | 2241266 | A | 8/1991 |
| GB | 2300208 | A | 10/1996 |
| GB | 2339815 | A | 2/2000 |
| GB | 2346628 | A | 8/2000 |
| GB | 2 360 304 | A | 9/2001 |
| GB | 2363146 | A | 12/2001 |
| GB | 2 367 843 | B | 4/2002 |
| GB | 2379699 | A | 3/2003 |
| SU | 295857 | | 4/1971 |
| SU | 398733 | | 2/1974 |
| SU | 420749 | | 9/1974 |
| SU | 436147 | | 12/1974 |
| SU | 515867 | | 7/1975 |
| SU | 933932 | A1 | 6/1982 |
| SU | 1461855 | A1 | 2/1989 |
| SU | 1654515 | A1 | 7/1991 |
| SU | 1691497 | A1 | 11/1991 |
| WO | WO-97/36084 | | 10/1997 |
| WO | WO-00/12859 | | 3/2000 |
| WO | WO-00/12860 | | 3/2000 |
| WO | WO-01/02832 | A1 | 1/2001 |
| WO | WO-01/33027 | A2 | 5/2001 |
| WO | WO-02/077407 | A1 | 10/2002 |

OTHER PUBLICATIONS

D. Ma, et al. "Dynamics of Roller Cone Bits", Journal of Energy Resources Technology, Dec. 1985, vol. 107 (pp. 543-548).

D. Ma, et al. "A New Way to Characterize the Grouging-Scraping Action of Roller Cone Bits", Society of Petroleum Engineers, 1989 (24 pgs.).

Boris L. Steklianov, "Increasing the Efficiency of Rock-Cutting Tools on the Basis of Comparative Analysis of the Kinetic Characteristics of Their Cutting Structure"; NDERI, 1990 (24 pages).

Robert L. McIntyre, "Surface Mine Rotary Drilling", Smith-Gruner (3 pages).

RockBit International, "System Designed to Speed Continuous Coring Operation", (4 pages).

RockBit International, "If You've Ever Doubted RBI's Ability to Drill at a Lower Cost Per Foot . . . Ask the Folks Drilling This Well", (4 pages).

RockBit International, "The Leader in High-Speed Drill Bit Technology" (24 pages).

Sandvik Rock Bits, "Sandvilk in the World of Oil and Gas" (8 pages).

B. L. Steklyanov, et al.; "Improving the effectiveness of Drilling Tools"; KhM-3 Oil Industry Machine Building; (1991) pp. 1-35.

Dekun Ma, et al.; "The Computer Simulation of the Interaction Between Roller Bit and Rock"; International Meeting on Petroleum Engineering; PR China; Nov. 14-17, 1995; pp. 309-317.

Ma Dekun, et al., "The Operational Mechanics of The Rock Bit", Petroleum Industry Press, 1996, pp. 1-243.

Society of Petroleum Engineers Paper No. 56439, "Field Investigation of the Effects of Stick-Slip, Lateral, and Whirl Vibrations on Roller Cone Bit Performance", S.L. Chen, et al., presented Oct. 3-6, 1999, (10 pages).

Society of Petroleum Engineers Paper No. 71053, "Development and Application of a New Roller Cone Bit with Optimized Tooth Orientation", S. L. Chen, et al., presented May 21-23, 2001, (15 pages).

Society of Petroleum Engineers Paper No. 71393, "Development and Field Applications of Roller Cone Bits with Balanced Cutting Structure", S. L. Chen, et al., presented Sep. 30-Oct. 3, 2001 (11 pages).

Hancke, et al., G.P. A Control System for Optimizing Deep Hole Drilling Conditions, IECON 1991 International Conference on Industrial Electronics, Control and Instrumentation, 1991, pp. 2279-2284.

Ertunc, et al., H. M. Real Time Monitoring of Tool Wear Using Multiple Modeling Method, IEEE International Electronics Machines and Drives Conference, IEMDC 2001, pp. 687-691.

Hancke, G. P. The Effective Control of a Deep Hole Diamond Drill, Conference REcord of the IEEE Industry Applications Society Annual Meeting, 1991, pp. 1200-1205.

Howie, et al., W. L. A Smart Bolter for Improving Entry Stability, Conference Record of the IEEE Industry Applications Society Annual Meeting, 1989, pp. 1556-1564.

United Kingdom Combined Search and Examination Report dated Aug. 9, 2005 (6 pages).

Burgess, T.M. & Lesso, Jr., W. G.; Measuring the Wear of Milled Tooth Bits Using MWD Torque and Weight-on-Bit; SPE/IADC 13475 (10 pages).

Reynolds, W.W.; Economic Analysis of Drilling Plans and Contractors by Use of a Drilling Systems Approach; SPE 13466 (pp. 787-793).

Technical Toolboxes, "DDC Drillstring Vibration Model"; Jun. 4, 2004 (11 pages).

Examiner's Search Report dated Jan. 25, 2002, 3 pages.

Yu Wang and Matthew T.Mason, "Two-Dimensional Rigid-Body Collisions wih Friction", Journal of Applied Mechanics, Sep. 1992, vol. 59, pp. 635 through 642.

T.M. Warren and W.K. Armagost, "Laboratory Drilling Performance of PDC Bits", Society of Petroleum Engineers, 61st Annual Technical Conference and Exhibition held in New Orleans, LA, Oct. 5-8, 1986, SPE 15617.

T.M. Warren and A. Sinor, "Drag Bit Performance Modeling", Society of Petroleum Engineers, 61st Annual Technical Conference and Exhibition held in New Orleans, LA, Oct. 5-8, 1986, SPE 15618.
R.K. Dropek, et al. "A Study to Determine Roller Cone Cutter Offset Effects at Various Drilling Depths", ASME, vol. 78-Pet-23, pp. 1-8, Jul. 21, 1978.
Ramsundar, Doodnath, "Bit Deviation Forces Due to Rock-Bit Interaction" University of Tulsa, pp. 1-119, 1976.
English Abstract of Belgium Patent No. BE-1013217 (2 pages).
English Abstract of European Patent No. EP-1046781 A1 (3 pages).
English Translation of Description of Invention No. SU-1691497 dated Nov. 15, 1991 (4 pages).
English Translation of Description of Invention No. SU-1654515 dated Jul. 7, 1991 (4 pages).
English Translation of Description of Invention No. SU-1461855 dated Feb. 28, 1999 (3 pages).
English Translation of Description of Invention No. SU-933932 dated Jun. 7, 1982 (2 pages).
English Translation of Description of Invention No. SU-295857 dated Apr. 14, 1971 (2 pages).
English Translation of Description of Invention No. SU-398733 dated Feb. 9, 1974 (2 pages).
English Translation of Description of Invention No. SU-420749 dated Sep. 2, 1974 (2 pages).
English Translation of Description of Invention No. SU-229371 dated Feb. 26, 1968 (1 page).
English Translation of Description of Invention No. SU-436147 dated Dec. 9, 1974 (2 pages).
English Translation of Description of Invention No. SU-515867 dated Jul. 12, 1975 (2 pages).

* cited by examiner

SIMULATING THE DYNAMIC RESPONSE OF A DRILLING TOOL ASSEMBLY AND ITS APPLICATION TO DRILLING TOOL ASSEMBLY DESIGN OPTIMIZATION AND DRILLING PERFORMANCE OPTIMIZATION

CROSS-REFERENCE TO RELATED APPLICATIONS

This application claims priority from U.S. patent application Ser. No. 09/689,299 filed on Oct. 11, 2000 now U.S. Pat. No. 6,785,641.

FIELD OF THE INVENTION

The invention relates generally to drilling a wellbore, and more specifically to simulating the drilling performance of a drilling tool assembly drilling a wellbore. In particular, the invention relates to methods for simulating the dynamic response of a drilling tool assembly, methods for optimizing a drilling tool assembly design, and methods for optimizing the drilling performance of a drilling tool assembly.

BACKGROUND OF THE INVENTION

FIG. 1 shows one example of a conventional drilling system for drilling an earth formation. The drilling system includes a drilling rig 10 used to turn a drilling tool assembly 12 which extends downward into a wellbore 14. The drilling tool assembly 12 includes a drilling string 16, and a bottomhole assembly (BHA) 18, attached to the distal end of the drill string 16.

The drill string 16 comprises several joints of drill pipe 16*a* connected end to end through tool joints 16*b*. The drill string 16 transmits drilling fluid (through its hollow core) and transmits rotational power from the drill rig 10 to the BHA 18. In some cases the drill string 16 further includes additional components such as subs, pup joints, etc.

The BHA 18 includes at least a drill bit 20. Typical BHAs may also include additional components attached between the drill string 16 and the drill bit 20. Examples of additional BHA components include drill collars, stabilizers, measurement-while-drilling (MWD) tools, logging-while-drilling (LWD) tools, and downhole motors.

In general, drilling tool assemblies 12 may include other drilling components and accessories, such as special valves, such as kelly cocks, blowout preventers, and safety valves. Additional components included in a drilling tool assembly 12 may be considered a part of the drill string 16 or a part of the BHA 18 depending on their locations in the drilling tool assembly 12.

The drill bit 20 in the BHA 18 may be any type of drill bit suitable for drilling earth formation. Two common types of earth boring bits used for drilling earth formations are fixed-cutter (or fixed-head) bits and roller cone bits. FIG. 2 shows one example of a fixed-cutter bit. FIG. 3 shows one example of a roller cone bit.

Referring to FIG. 2, fixed-cutter bits (also called drag bits) 21 typically comprise a bit body 22 having a threaded connection at one end 24 and a cutting head 26 formed at the other end. The head 26 of the fixed-cutter bit 21 typically comprises a plurality of ribs or blades 28 arranged about the rotational axis of the bit and extending radially outward from the bit body 22. Cutting elements 29 are embedded in the raised ribs 28 to cut formation as the bit is rotated on a bottom surface of a wellbore. Cutting elements 29 of fixed-cutter bits typically comprise polycrystalline diamond compacts (PDC) or specially manufactured diamond cutters. These bits are also referred to as PDC bits.

Referring to FIG. 3, roller cone bits 30 typically comprise a bit body 32 having a threaded connection at one end 34 and a plurality of legs (not shown) extending from the other end. A roller cone 36 is mounted on each of the legs and is able to rotate with respect to the bit body 32. On each cone 36 of the bit 30 are a plurality of cutting elements 38, typically arranged in rows about the surface of the cone 36 to contact and cut through formation encountered by the bit. Roller cone bits 30 are designed such that as a drill bit rotates, the cones 36 of the bit 30 roll on the bottom surface of the wellbore (called the "bottomhole") and the cutting elements 38 scrape and crush the formation beneath them. In some cases, the cutting elements 38 on the roller cone bit 30 comprise milled steel teeth formed on the surface of the cones 36. In other cases, the cutting elements 38 comprise inserts embedded in the cones. Typically, these inserts are tungsten carbide inserts or polycrystalline diamond compacts. In some cases hardfacing is applied to the surface of the cutting elements to improve wear resistance of the cutting structure.

For a drill bit 20 to drill through formation, sufficient rotational moment and axial force must be applied to the bit 20 to cause the cutting elements of the bit 20 to cut into and/or crush formation as the bit is rotated. The axial force applied on the bit 20 is typically referred to as the "weight on bit" (WOB). The rotational moment applied to the drilling tool assembly 12 at the drill rig 10 (usually by a rotary table) to turn the drilling tool assembly 12 is referred to as the "rotary torque". The speed at which the rotary table rotates the drilling tool assembly 12, typically measured in revolutions per minute (RPM), is referred to as the "rotary speed". Additionally, the portion of the weight of the drilling tool assembly supported at the rig 10 by the suspending mechanism (or hook) is typically referred to as the hook load.

During drilling, the actual WOB is not constant. Some of the fluctuation in the force applied to the bit may be the result of the bit contacting with formation having harder and softer portions that break unevenly. However, in most cases, the majority of the fluctuation in the WOB can be attributed to drilling tool assembly vibrations. Drilling tool assemblies can extend more than a mile in length while being less than a foot in diameter. As a result, these assemblies are relatively flexible along their length and may vibrate when driven rotationally by the rotary table. Several modes of vibration are possible for drilling tool assemblies. In general, drilling tool assemblies may experience torsional, axial and lateral vibrations. Although partial damping of vibration may result due to viscosity of drilling fluid, friction of the drill pipe rubbing against the wall of the wellbore, energy absorbed in drilling the formation, and drilling tool assembly impacting with wellbore wall, these sources of damping are typically not enough to suppress vibrations completely.

Up to now, vibrations of a drilling tool assembly have been difficult to predict because different forces may combine to produce the various modes of vibration, and models for simulating the response of an entire drilling tool assembly including roller cone bit interacting with formation in a drilling environment have not been available. However, drilling tool assembly vibrations are generally undesirable, not only because they are difficult to predict, but also because they can significantly affect the instantaneous force applied on the bit. This can result in the bit not operating as expected. For example, vibrations can result in off-centered drilling, slower rates of penetration, excessive wear of the cutting elements, or premature failure of the cutting elements and the bit. Lateral vibration of the drilling tool assembly may be a result of radial force imbalances, mass imbalance, and bit/formation interaction, among other things. Lateral vibration results in poor drilling tool assembly performance, overgage hole drilling, out-of-round, or "lobed" wellbores and premature failure of both the cutting elements and bit bearings.

When the bit wears out or breaks during drilling, the entire drilling tool assembly must be lifted out of the wellbore section-by-section and disassembled in an operation called a "pipe trip". In this operation, a heavy hoist is required to pull the drilling tool assembly out of the wellbore in stages so that each stand of pipe (typically pipe sections of about 90 feet) can be unscrewed and racked for the later re-assembly. Because the length of a drilling tool assembly may extend for more than a mile, pipe trips can take several hours and can pose a significant expense to the wellbore operator and drilling budget. Therefore, the ability to design drilling tool assemblies which have increased durability and longevity, for example, by minimizing the wear on the drilling tool assembly due to vibrations, is very important and greatly desired to minimize pipe trips out of the wellbore and to more accurately predict the resulting geometry of the wellbore drilled.

Simulation methods have been previously introduced which characterize either the interaction of a bit with the bottomhole surface of a wellbore or the dynamics of a bottomhole assembly (BHA). However, no prior art simulation techniques have been developed to cover the dynamic modeling of an entire drilling tool assembly. As a result, the dynamic response of a drilling tool assembly or the effect of a change in configuration on drilling tool assembly performance can not be accurately predicted.

One simulation method for characterizing interaction between a roller cone bit and an earth formation is described in U.S. patent application Ser. No. 09/524,088, entitled "Method for Simulating Drilling of Roller Cone Bits and its Application to Roller Cone Bit Design and Performance", and assigned to the assignee of the present invention. This application discusses general methods for predicting cutting element interaction with earth formations. The application also discussed types of experimental tests that can be performed to obtain cutting element/formation interaction data. Another simulation method for characterizing cutting element/formation interaction for a roller cone bit is described in Society of Petroleum Engineers (SPE) Paper No. 29922 by D. Ma et al., entitled, "The Computer Simulation of the Interaction Between Roller Bit and Rock".

Methods for optimizing tooth orientation on a roller cone bits are disclosed in PCT International Publication No. WO00/12859 entitled, "Force-Balanced Roller-Cone Bits, Systems, Drilling Methods, and Design Methods" and PCT International Publication No. WO00/12860 entitled, "Roller-Cone Bits, Systems, Drilling Methods, and Design Methods with Optimization of Tooth Orientation.

Similarly, SPE Paper No. 15618 by T. M. Warren et. al., entitled "Drag Bit Performance Modeling" discloses a method for simulating the performance of PDC bits. Also disclosed are methods for defining the bit geometry, and methods for modeling forces on cutting elements and cutting element wear during drilling based on experimental test data. Examples of experimental tests that can be performed to obtain cutting element/earth formation interaction data are also disclosed. Experimental methods that can be performed on bits in earth formations to characterize bit/earth formation interaction are discussed in SPE Paper No. 15617 by T. M. Warren et al., entitled "Laboratory Drilling Performance of PDC Bits".

While prior art simulation methods, such as those described above cover either the interaction of the bit with the formation or the BHA dynamics, no prior art simulation technique has been developed to cover the dynamic modeling of the entire drilling tool assembly. As a result, accurately predicting the response of a drilling tool assembly has been virtually impossible. Additionally, the change in the dynamic response of a drilling tool assembly when a component of the drilling tool assembly is changed is not well understood.

In view of the above it is clear that a method for simulating the dynamic response of an entire drilling tool assembly, which takes into account bit interaction with the bottom surface of the wellbore, drilling tool assembly interaction with the wall of the wellbore and damping effects of the drilling fluid on the drill pipe, is both needed and desired. Additionally, a model for predicting changes in drilling tool assembly performance due to changes in drilling tool assembly configuration, and for determining optimal drilling tool assembly designs and/or optimal drilling operating parameters (WOB, RPM, etc.) for a particular depth, formation, and/or drilling tool assembly is desired.

SUMMARY OF THE INVENTION

The invention provides methods for simulating the dynamic response of a drilling tool assembly drilling an earth formation. The drilling tool assembly comprises at least a drill pipe and a drill bit. Methods for simulating the dynamic response of drilling tool assemblies may be used to generate a visual representation of drilling, to design drilling tool assemblies, and to optimize the drilling performance of a drilling tool assembly.

One method for generating a visual representation of a drilling tool assembly which comprising at least a drill pipe and a drill bit comprises solving for a dynamic response of the drilling tool assembly to an incremental rotation, determining, based on the dynamic response, parameters of craters removed from a bottomhole surface of the formation due to contact of the bit with the bottomhole surface during the incremental rotation, and calculating a bottomhole geometry, wherein the craters are removed from the bottomhole surface. The method further comprises repeating the solving, determining, and calculating for a select number of successive incremental rotations, and converting the dynamic responses and the bottomhole geometry parameters into a visual representation.

One method for optimizing a drilling tool assembly design comprises simulating a dynamic response of the drilling tool assembly, adjusting a value of at least one drilling tool assembly design parameter, and repeating the simulating. The method further comprises repeating the adjusting and the simulating until at least one drilling performance parameter is determined to be at an optimum value.

One method for determining at least one optimal drilling operating parameter for a drilling tool assembly comprises simulating a dynamic response of the drilling tool assembly, adjusting the value of at least one drilling operating parameter, and repeating the simulating. The method further includes repeating the adjusting and the simulating until at least one drilling performance parameter is determined to be at an optimal value.

One method for designing a drilling tool assembly comprises defining initial drilling tool assembly design parameters, simulating the dynamic response of the drilling tool assembly, adjusting a value of at least one of the drilling tool assembly design parameters, and repeating the simulating and the adjusting a select number of times. The method further comprises evaluating the dynamic responses, and selecting, based on the evaluating, desired drilling tool assembly design parameters.

Other aspects and advantages of the invention will be apparent from the following description and the appended claims.

DETAILED DESCRIPTION OF THE INVENTION

The invention provides methods for simulating the dynamic response of a drilling tool assembly drilling an earth formation, methods for optimizing a drilling tool assembly design, and methods for optimizing drilling tool assembly performance.

In accordance with the invention, a drilling tool assembly comprises at least one segment (or joint) of drill pipe and a drill bit. The components of a drilling tool assembly may be more generally referred to as a drill string and a bottomhole assembly (BHA). The drill string comprises one or more joints of drill pipe. The BHA comprises at least a drill bit.

In a typical drilling tool assembly, the drill string comprises several joints of drill pipe connected end to end, and the bottomhole assembly comprises one or more drill collars and a drill bit attached to an end of the BHA. The drill string may further include additional components, such as a kelly, kelly cocks, blowout preventers, safety valves, etc. The BHA may further include additional components, such as stabilizers, a downhole motor, MWD tools, and LWD tools, for example. Therefore, in accordance with the invention, a drilling tool assembly may be as simple as a single segment of drill pipe attached to a drill bit, or as complex as a multi-component drill string which includes a kelly, a lower kelly cock, a kelly saver sub, several joints of drill pipe with tool joints, etc., and a multi-component BHA which includes drill collars, stabilizers, and additional specialty items (e.g., subs, pup joints, reamers, valves, MWD tools, LWD tools, and a drill bit).

While in practice, a BHA comprises at least a drill bit, in embodiments of the invention discussed below, the parameters of the drill bit, required for modeling interaction between the drill bit and the bottomhole surface, are generally considered separately from the BHA parameters. This separate consideration of the bit allows for interchangeable use of any drill bit model as determined by the system designer.

Figure 1:
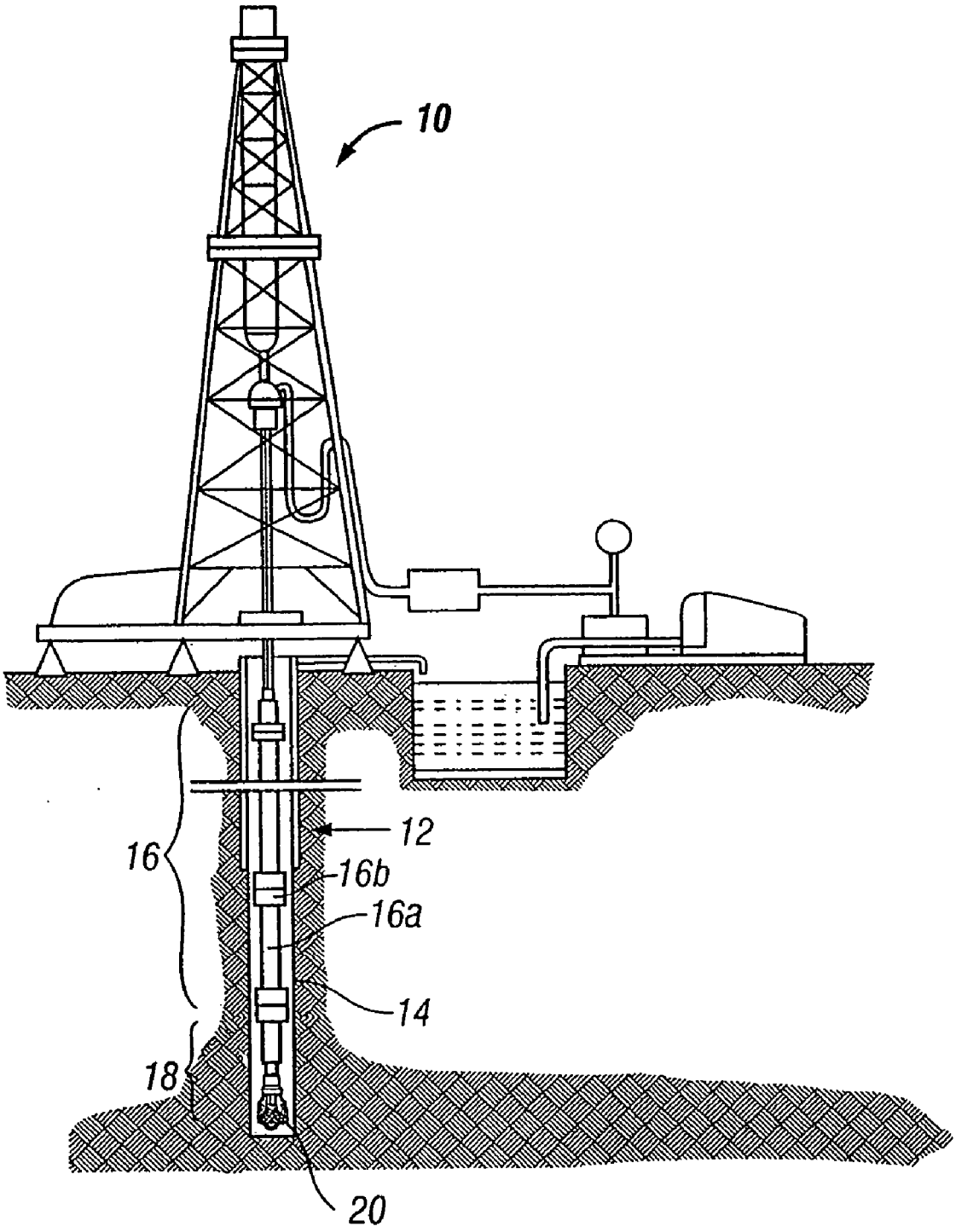
FIG. 1 (Prior Art)
FIG. 1 shows a schematic diagram of a prior art drilling system for drilling earth formations.
Figure 2:
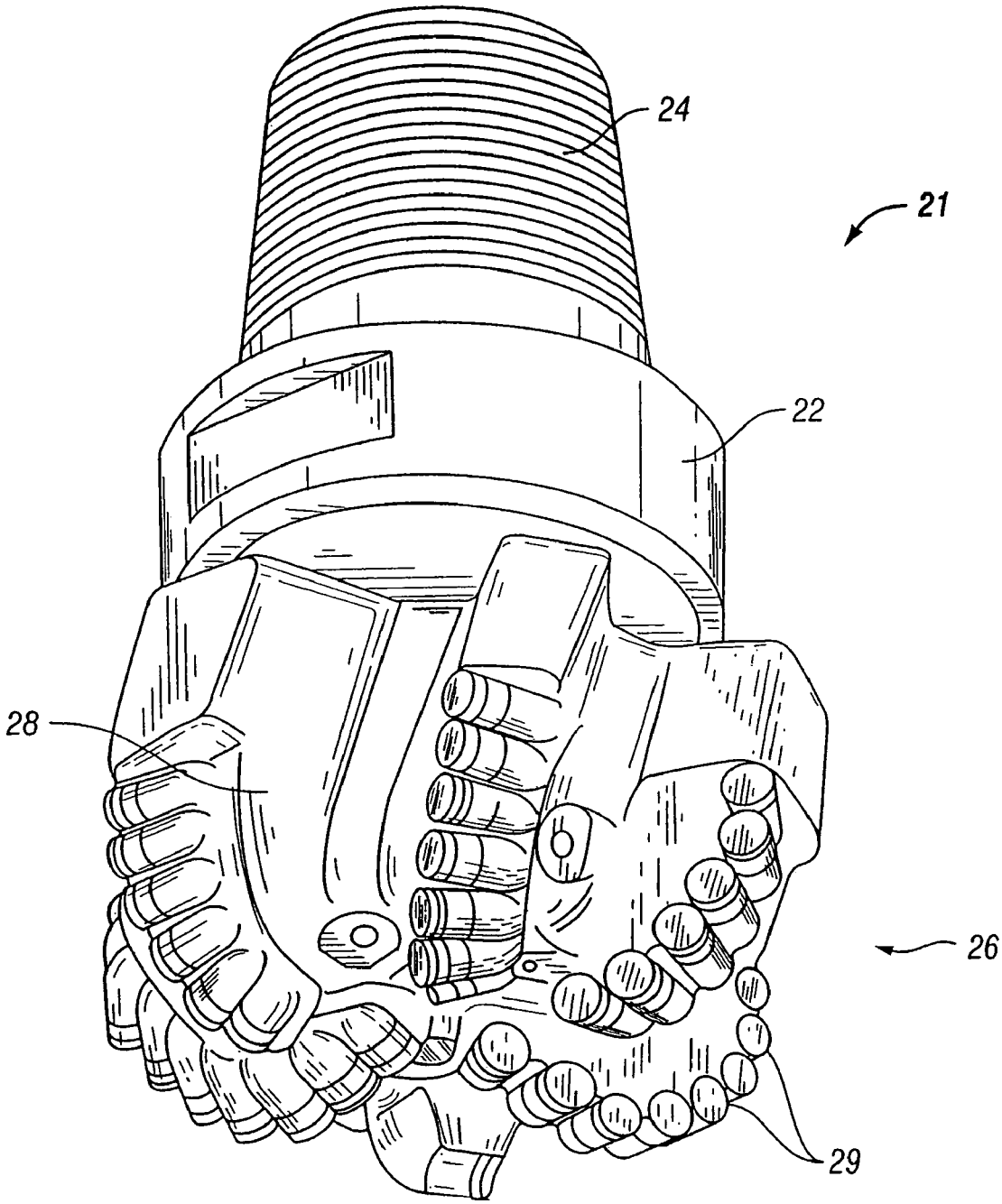
FIG. 2 (Prior Art)
FIG. 2 shows a perspective view of a prior art fixed-cutter bit.
Figure 3:
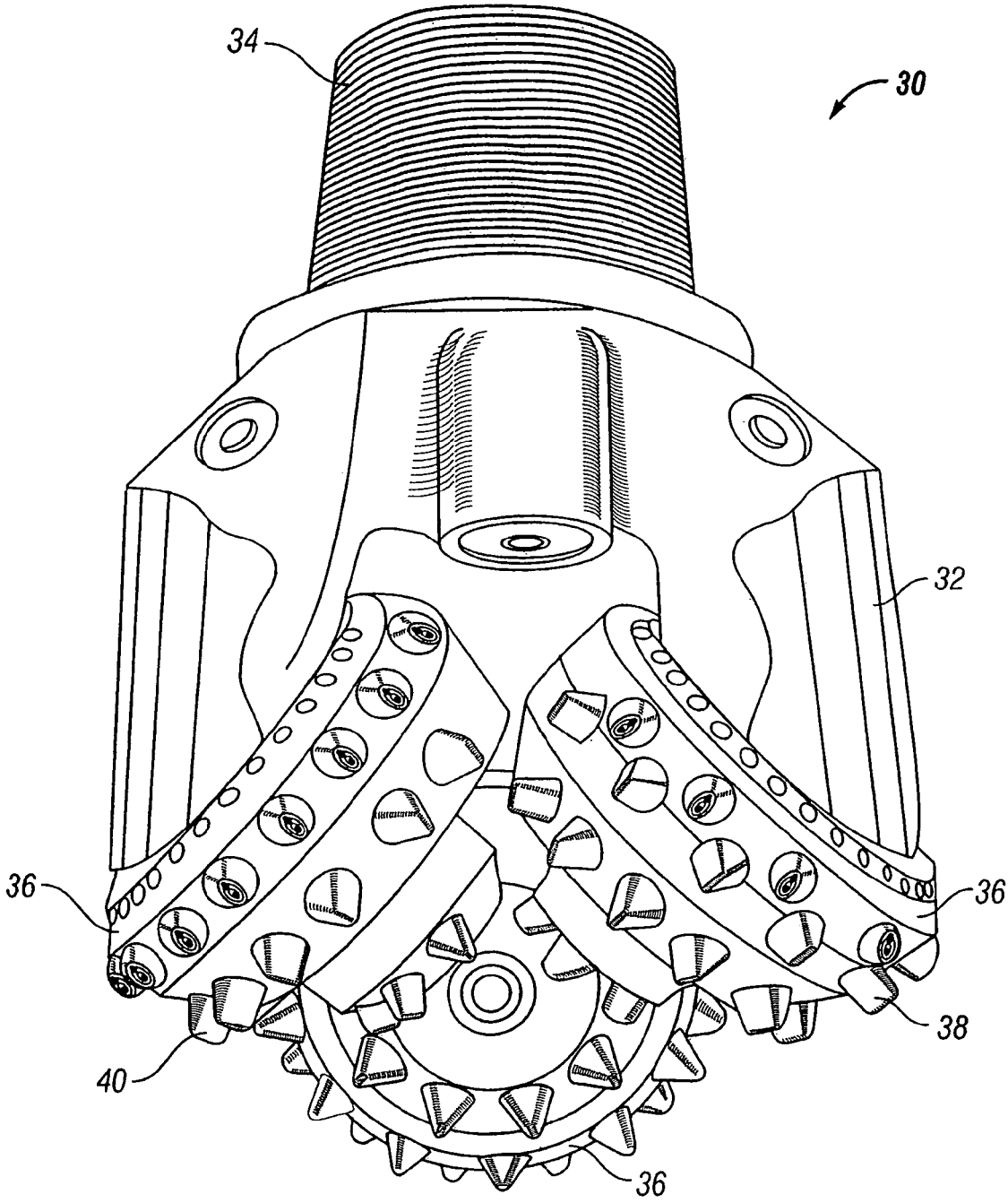
FIG. 3 (Prior Art)
FIG. 3 shows a perspective view of a prior art roller cone bit.
Figure 4:
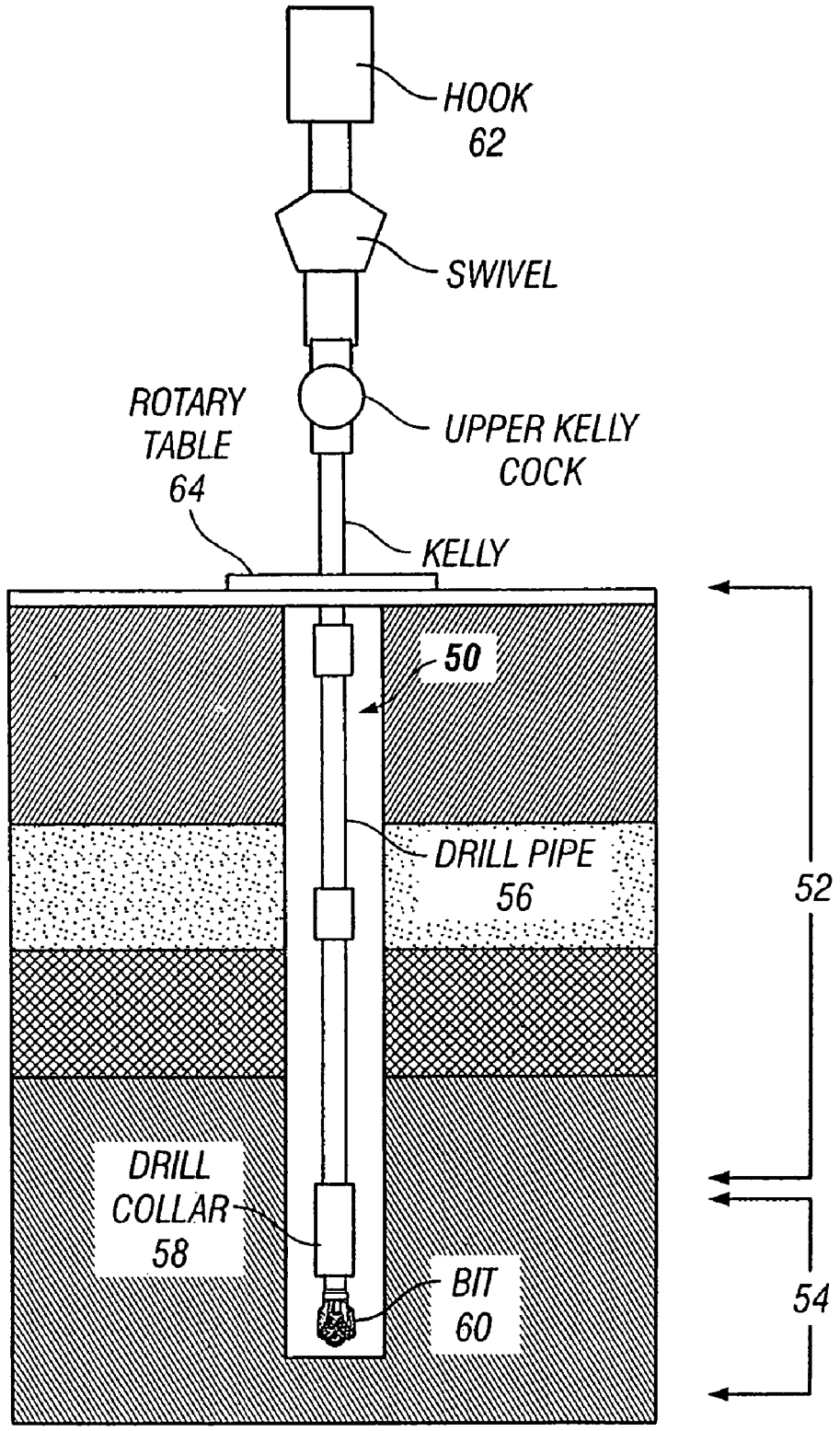
FIG. 4, shows one example of drilling tool assembly.

One example of a drilling tool assembly 50 is shown in FIG. 4. In this embodiment, the drilling tool assembly is suspended from a hook 62 and rotated by a rotary table 64. The drilling tool assembly 50 comprises a drill string 52 and BHA 54. The drill string 52 comprises a plurality of joints of drill pipe 56. The BHA 54 comprises a drill collar 58 and a drill bit 60. The drill bit 62 shown in this example is a roller cone drill bit. In other embodiments any type of drill bit may be used.

To simulate the dynamic response of a drilling tool assembly, such as the one shown in FIG. 4, for example, components of the drilling tool assembly need to be mathematically defined. For example, the drill string may generally be defined in terms of geometric and material parameters, such as the total length, the total weight, inside diameter (ID), outside diameter (OD), and material properties of the various components of the drill string. Material properties of the drill string components may include the strength, and elasticity of the component material. Each component of the drill string may be individually defined or various parts may be defined in the aggregate. For example, a drill string comprising a plurality of substantially identical joints of drill pipe may be defined by the number of drill pipe joints of the drill string, and the ID, OD, length, and material properties for one drill pipe joint. Similarly, the BHA may be defined in terms of parameters, such as the ID, OD, length, and material properties of one drill collar and of any other component that makes up the BHA.

The geometry and material properties of the drill bit also need to be defined as required for the method selected for simulating drill bit interaction with the earth formation at the bottom surface of the wellbore. One example of a method for simulating a roller cone drill bit drilling an earth formation can be found in the previously mentioned U.S. patent application Ser. No. 09/524,088, assigned to the assignee of the present invention and now incorporated herein by reference in its entirety.

To simulate the dynamic response of a drilling tool assembly drilling earth formation, the wellbore trajectory, in which the drilling tool assembly is to be confined also needs to be defined along with an initial wellbore bottom surface geometry. Because the wellbore trajectory may be straight, curved, or a combination of straight and curved sections, wellbore trajectories, in general, may be defined by defining parameters for each segment of the trajectory. For example, a wellbore comprising N segments may be defined by the length, diameter, inclination angle, and azimuth direction of each segment and an indication of the order of the segments (i.e., first, second, etc.). Wellbore parameters defined in this manner can then be used to mathematically produce a model of the entire wellbore trajectory. Formation material properties along the wellbore may also be defined and used. Additionally, drilling operating parameters, such as the speed at which the drilling tool assembly is rotated and the hook load (weight of the drilling tool assembly suspended at the hook 62), also need to be defined.

Once the parameters of the system (drilling tool assembly under drilling conditions) are defined, they can be used along with various interaction models to simulate the dynamic response of the drilling tool assembly drilling earth formation as described below.

Method for Simulating the Dynamic Response of Drilling Tool Assembly

In one aspect, the invention provides a method for simulating the dynamic response of a drilling tool assembly drilling earth formation. Advantageously, this method takes into account interaction between the entire drilling tool assembly and the drilling environment. Interaction between the drilling tool assembly and the drilling environment may include interaction between the drill bit at the end of the drilling tool assembly and the formation at the bottom of the wellbore. Interaction between the drilling tool assembly and the drilling environment also may include interaction between the drilling tool assembly and the side (or wall) of the wellbore. Further, interaction between the drilling tool assembly and drilling environment may include viscous damping effects of the drilling fluid on the dynamic response of the drilling tool assembly.

Figure 5:
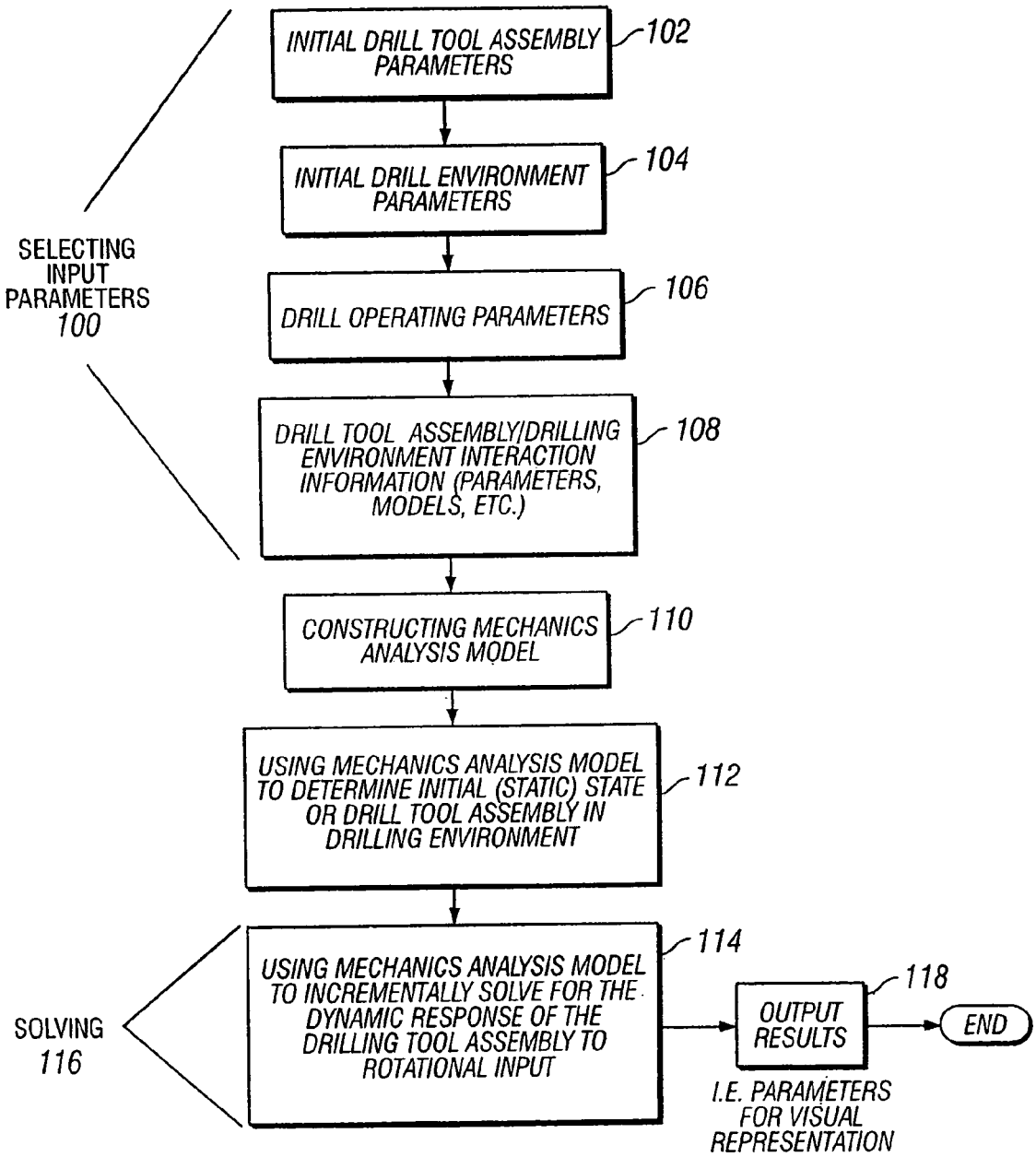
FIG. 5 shows a flow chart of one embodiment of a method for simulating the dynamic response of a drilling tool assembly.

A flow chart for one embodiment of the invention is illustrated in FIG. 5. The first step in this embodiment is selecting (defining or otherwise providing) parameters 100, including initial drilling tool assembly parameters 102, initial drilling environment parameters 104, drilling operating parameters 106, and drilling tool assembly/drilling environment interaction information (parameters and/or models) 108. The nest step involves constructing a mechanics analysis model of the drilling tool assembly 110. The mechanics analysis model can be constructed using the drilling tool assembly parameters 102 and Newton's law of motion. The next step involves determining an initial static state of the drilling tool assembly 112 in the selected drilling environment using the mechanics analysis model 110 along with drilling environment parameters 104 and drilling tool assembly/drilling environment interaction information 108. Once the mechanics analysis model is constructed and an initial static state of the drill string is determined, the resulting static state parameters can be used with the drilling operating parameters 106 to incrementally solve for the dynamic response 114 of the drilling tool assembly 50 to rotational input from the rotary table 64 and the hook load provided at the hook 62. Once a simulated response for an increment in time (or for the total time) is obtained, results from the simulation can be provided as output 118, and used to generate a visual representation of drilling if desired.

Figure 6:
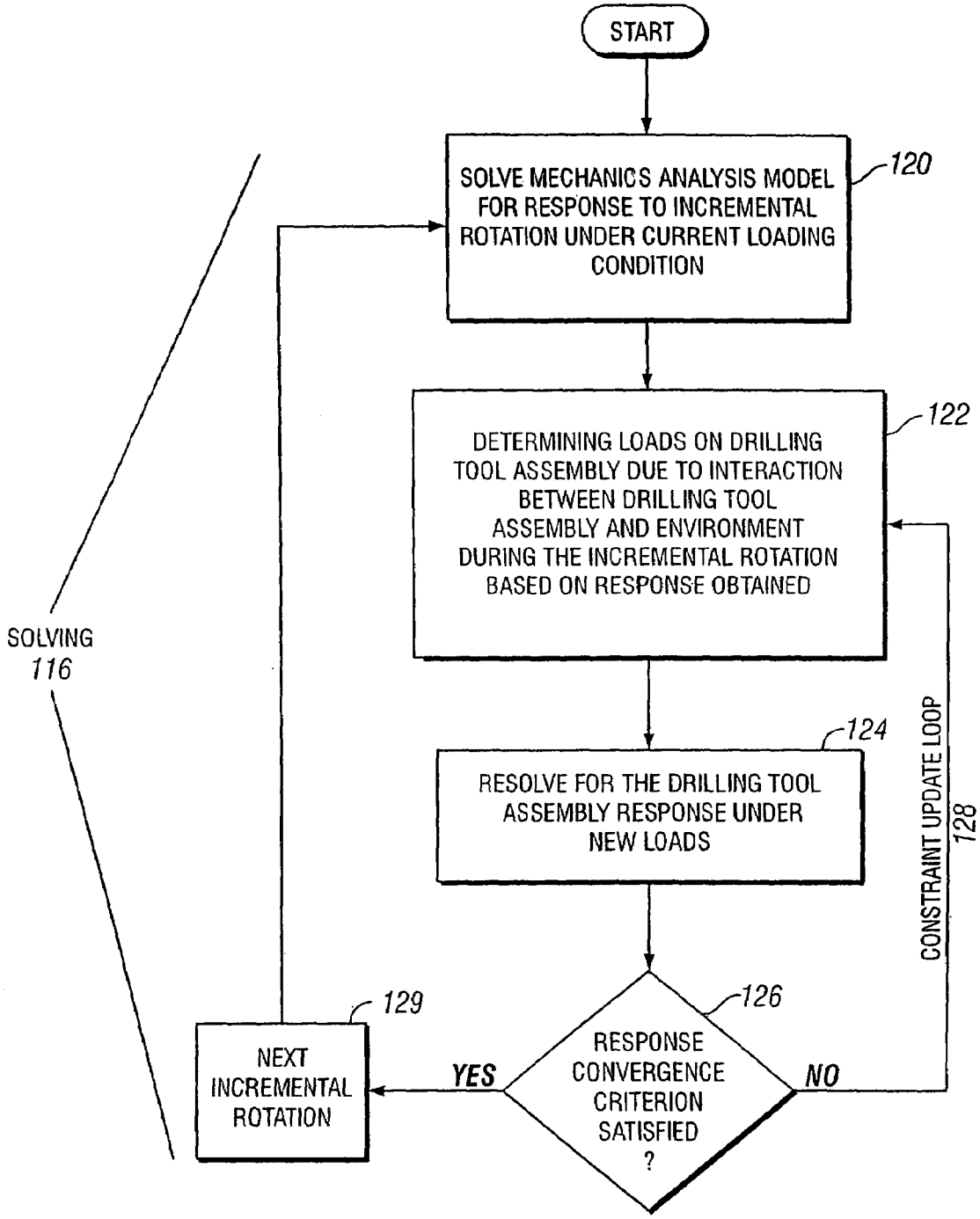
FIG. 6 shows a flow chart of one method of incrementally solving for the dynamic response of a drilling tool assembly.
Figure 7A:
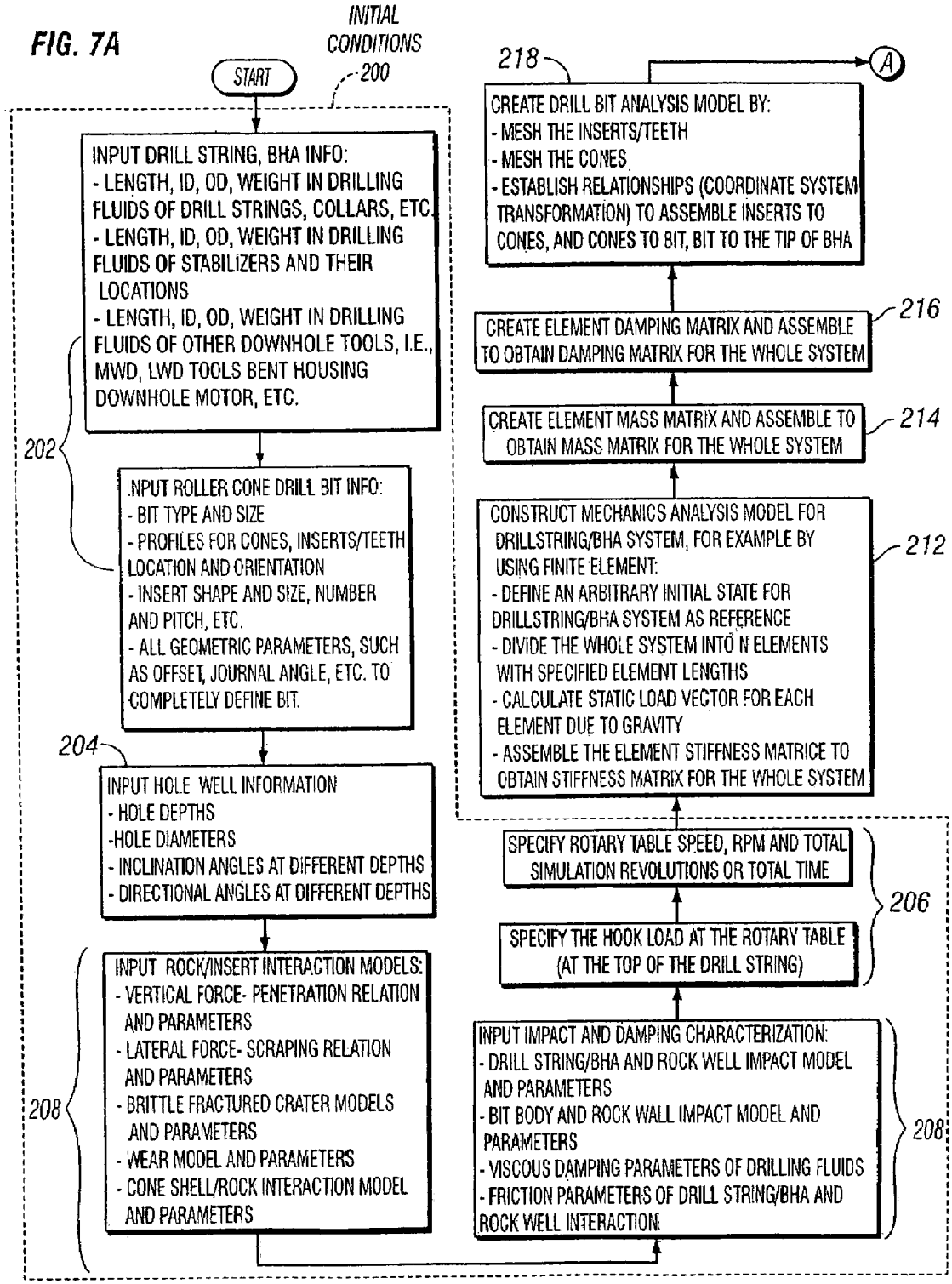
FIGS. 7A–D shows a more detailed flow chart of a method for incrementally solving for the dynamic response of a drilling tool assembly in which constraint loads are updated to account for interaction between the drilling tool assembly and the drilling environment during the incremental rotation.
Figure 7B:
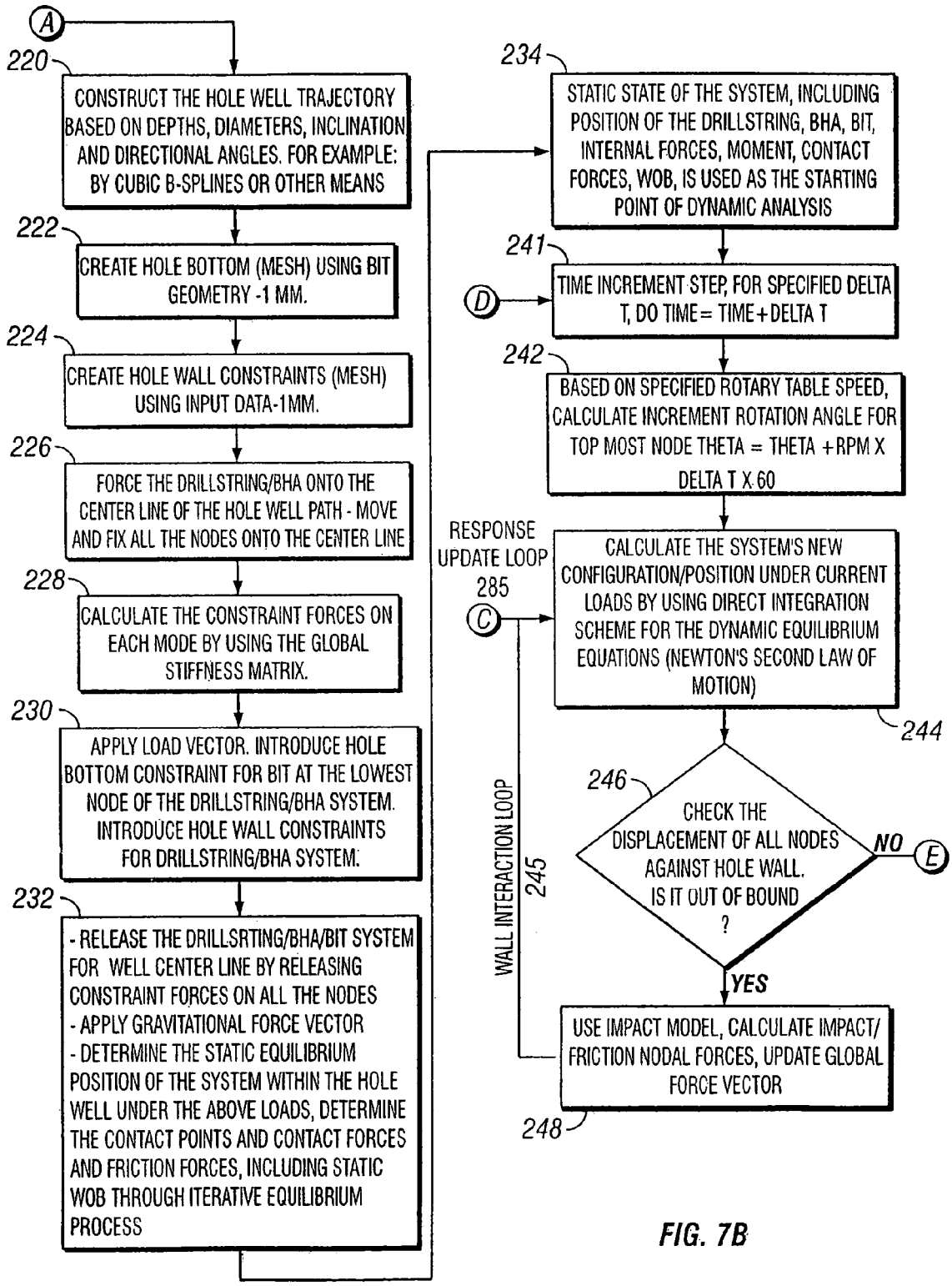
Figure 7C:
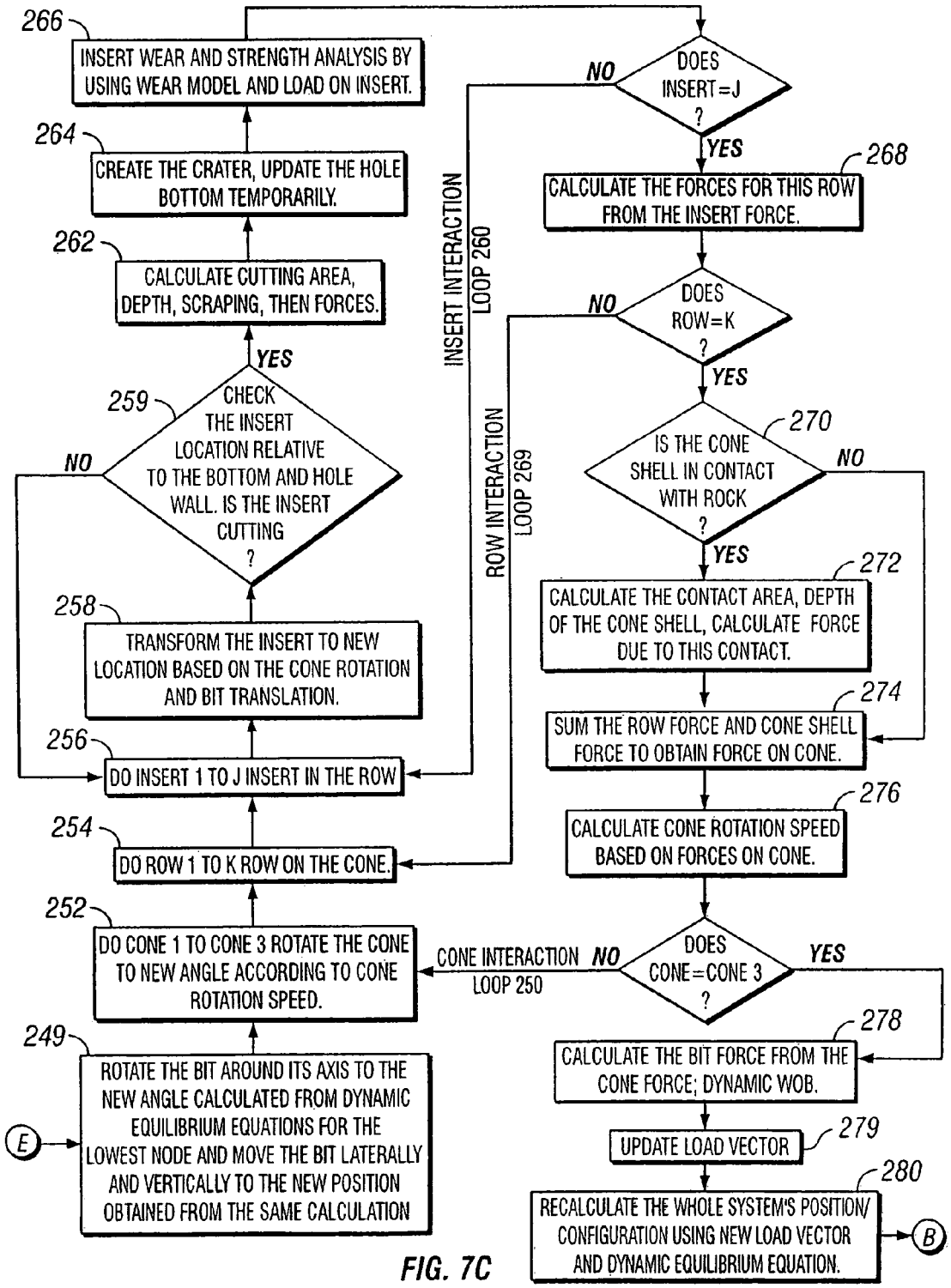
Figure 7D:
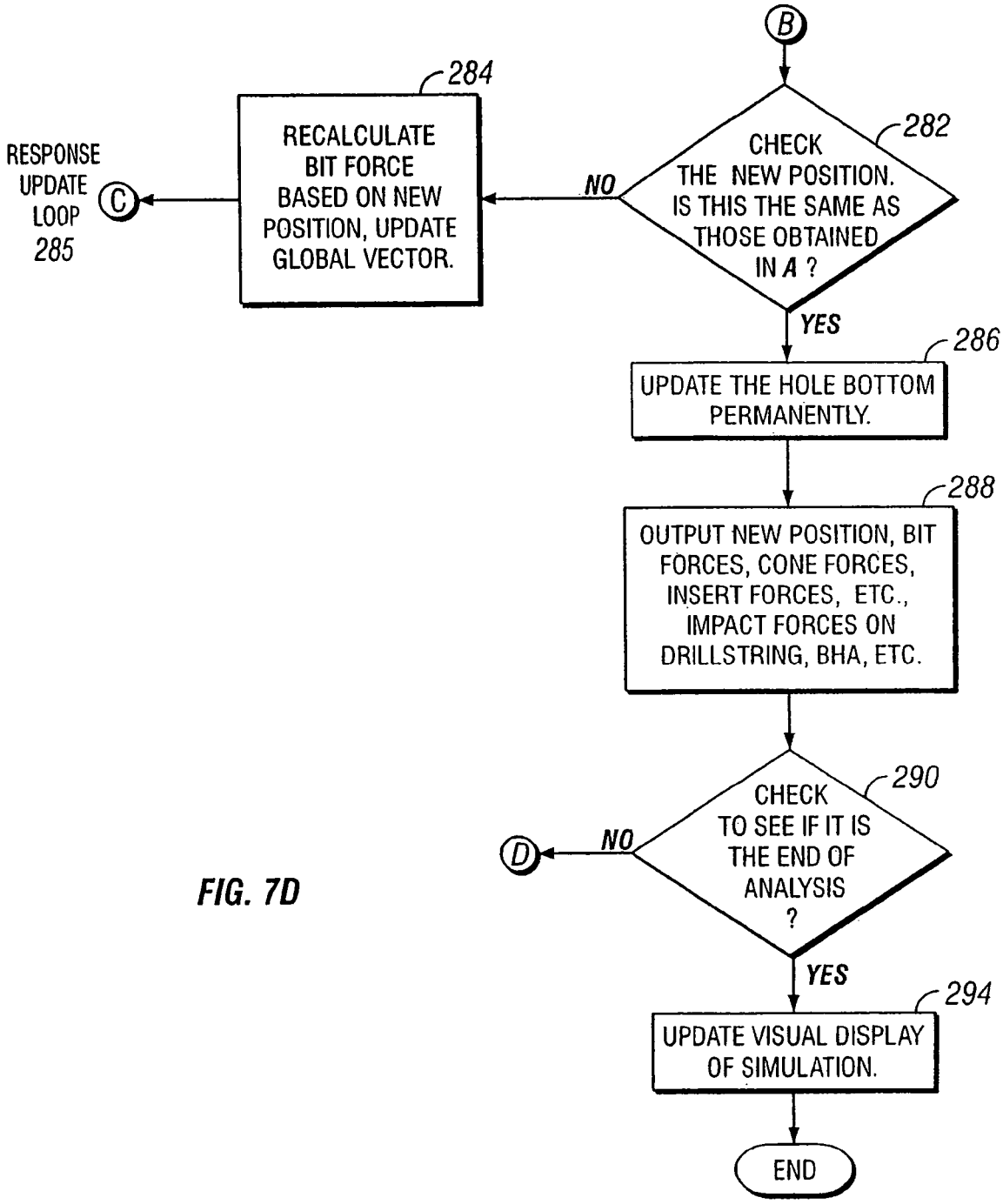

In one example, illustrated in FIG. 6, incrementally solving for the dynamic response (indicated as 116) may not only include solving the mechanics analysis model for the dynamic response to an incremental rotation, at 120, but may also include determining, from the response obtained, loads (e.g., drilling environment interaction forces) on the drilling tool assembly due to interaction between the drilling tool assembly and the drilling environment during the incremental rotation, at 122, and resolving for the response of the drilling tool assembly to the incremental rotation, at 124, under the newly determined loads. The determining and resolving may be repeated in a constraint update loop 128 until a response convergence criterion 126 is satisfied. Once a convergence criterion is satisfied, the entire incremental solving process 116 may be repeated for successive increments until an end condition for simulation is reached.

During the simulation, the constraint forces initially used for each new incremental calculation step may be the constraint forces determined during the last incremental rotation. In the simulation, incremental rotation calculations are repeated for a select number of successive incremental rotations until an end condition for simulation is reached. A more detailed example of an embodiment of the invention is shown in FIG. 7A–D.

For the example shown in FIG. 7A–D, the parameters provided as input 200 include drilling tool assembly design parameters 202, initial drilling environment parameters 204, drilling operating parameters 206, and drilling tool assembly/drilling environment interaction parameters and/or models 208.

Drilling tool assembly design parameters 202 may include drill string design parameters, BHA design parameters, and drill bit design parameters. In the example shown, the drill string comprises a plurality of joints of drill pipe, and the BHA comprises drill collars, stabilizers, bent housings, and other downhole tools (e.g., MWD tools, LWD tools, downhole motor, etc.), and a drill bit. As noted above, while the drill bit, generally, is considered a part of the BHA, in this example the design parameters of the drill bit are shown separately to illustrate that any type of drill bit may be defined and modeled using any drill bit analysis model.

Drill string design parameters include, for example, the length, inside diameter (ID), outside diameter (OD), weight (or density), and other material properties of the drill string in the aggregate. Alternatively, drill string design parameters may include the properties of each component of the drill string and the number of components and location of each component of the drill string. For example, the length, ID, OD, weight, and material properties of one joint of drill pipe may be provided along with the number of joints of drill pipe which make up the drill string. Material properties used may include the type of material and/or the strength, elasticity, and density of the material. The weight of the drill string, or individual components of the drill string may be provided as "weight in drilling fluids" (the weight of the component when submerged in the selected drilling fluid).

BHA design parameters include, for example, the bent angle and orientation of the motor, the length, equivalent inside diameter (ID), outside diameter (OD), weight (or density), and other material properties of each of the various components of the BHA. In this example, the drill collars, stabilizers, and other downhole tools are defined by their lengths, equivalent IDs, ODs, material properties, weight in drilling fluids, and position in the drilling tool assembly.

The drill bit design parameters include, for example, the bit type (roller cone, fixed-cutter, etc.) and geometric parameters of the bit. Geometric parameters of the bit may include the bit size (e.g., diameter), number of cutting elements, and the location, shape, size, and orientation of the cutting elements. In the case of a roller cone bit, drill bit design parameters may further include cone profiles, cone axis offset (offset from perpendicular with the bit axis of rotation), the number of cutting elements on each cone, the location, size, shape, orientation, etc. of each cutting element on each cone, and any other bit geometric parameters (e.g., journal angles, element spacings, etc.) to completely define the bit geometry. In general, bit, cutting element, and cone geometry may be converted to coordinates and provided as input. One preferred method for obtaining bit design parameters is the use of 3-dimensional CAD solid or surface models to facilitate geometric input. Drill bit design parameters may further include material properties, such as strength, hardness, etc. of components of the bit.

Initial drilling environment parameters 204 include, for example, wellbore parameters. Wellbore parameters may include wellbore trajectory (or geometric) parameters and wellbore formation parameters. Wellbore trajectory parameters may include an initial wellbore measured depth (or length), wellbore diameter, inclination angle, and azimuth direction of the wellbore trajectory. In the typical case of a wellbore comprising segments having different diameters or differing in direction, the wellbore trajectory information may include depths, diameters, inclination angles, and azimuth directions for each of the various segments. Wellbore trajectory information may further include an indication of the curvature of the segments (which may be used to determine the order of mathematical equations used to represent each segment). Wellbore formation parameters may include the type of formation being drilled and/or material properties of the formation such as the formation strength, hardness, plasticity, and elastic modulus.

Drilling operating parameters 206, in this embodiment, include the rotary table speed at which the drilling tool assembly is rotated (RPM), the downhole motor speed if a downhole motor is included, and the hook load. Drilling operating parameters 206 may further include drilling fluid parameters, such as the viscosity and density of the drilling fluid, for example. It should be understood that drilling operating parameters 206 are not limited to these variables. In other embodiments, drilling operating parameters 206 may include other variables, such as, for example, rotary torque and drilling fluid flow rate. Additionally, drilling operating parameters 206 for the purpose of simulation may further include the total number of bit revolutions to be simulated or the total drilling time desired for simulation. However, it should be understood that total revolutions and total drilling time are simply end conditions that can be provided as input to control the stopping point of simulation, and are not necessary for the calculation required for simulation. Additionally, in other embodiments, other end conditions may be provided, such as total drilling depth to be simulated, or by operator command, for example.

Drilling tool assembly/drilling environment interaction information 208 includes, for example, cutting element/earth formation interaction models (or parameters) and drilling tool assembly/formation impact, friction, and damping models and/or parameters. Cutting element/earth formation interaction models may include vertical force-penetration relations and/or parameters which characterize the relationship between the axial force of a selected cutting element on a selected formation and the corresponding penetration of the cutting element into the formation. Cutting element/earth formation interaction models may also include lateral force-scraping relations and/or parameters which characterize the relationship between the lateral force of a selected cutting element on a selected formation and the corresponding scraping of the formation by the cutting element. Cutting element/formation interaction models may also include brittle fracture crater models and/or parameters for predicting formation craters which will likely result in brittle fracture, wear models and/or parameters for predicting cutting element wear resulting from contact with the formation, and cone shell/formation or bit body/formation interaction models and/or parameters for determining forces on the bit resulting from cone shell/formation or bit body/formation interaction. One example of methods for obtaining or determining drilling tool assembly/formation interaction models or parameters can be found in previously noted U.S. patent application Ser. No. 09/524,088, assigned to the assignee of the present invention and incorporated herein by reference. Other methods for modeling drill bit interaction with a formation can be found in the previously noted SPE Papers No. 29922, No. 15617, and No. 15618, and PCT International Publication Nos. WO 00/12859 and WO 00/12860.

Drilling tool assembly/formation impact, friction, and damping models and/or parameters characterize impact and friction on the drilling tool assembly due to contact with the wall of the wellbore and the viscous damping effects of the drilling fluid. These models/parameters include, for example, drill string-BHA/formation impact models and/or parameters, bit body/formation impact models and/or parameters, drill string-BHA/formation friction models and/or parameters, and drilling fluid viscous damping models and/or parameters. One skilled in the art will appreciate that impact, friction and damping models/parameters may be obtained through laboratory experimentation, in a method similar to that disclosed in the prior art for drill bits interaction models/parameters. Alternatively, these models may also be derived based on mechanical properties of the formation and the drilling tool assembly, or may be obtained from literature. Prior art methods for determining impact and friction models are shown, for example, in papers such as the one by Yu Wang and Matthew Mason, entitled "Two-Dimensional Rigid-Body Collisions with Friction", *Journal of Applied Mechanics*, September 1992, Vol. 59, pp. 635–642.

As shown in FIG. 7A–D, once input parameters/models 200 are selected, determined, or otherwise provided, a two-part mechanics analysis model of the drilling tool assembly is constructed (at 210) and used to determine the initial static state (at 232) of the drilling tool assembly in the wellbore. The first part of the mechanics analysis model 210*a* takes into consideration the overall structure of the drilling tool assembly, with the drill bit being only generally represented. In this embodiment, for example, a finite element method is used (generally described at 212) wherein an arbitrary initial state (such as hanging in the vertical mode free of bending stresses) is defined for the drilling tool assembly as a reference and the drilling tool assembly is divided into N elements of specified element lengths (i.e., meshed). The static load vector for each element due to gravity is calculated. Then element stiffness matrices are constructed based on the material properties (e.g., elasticity), element length, and cross sectional geometrical properties of drilling tool assembly components provided as input and are used to construct a stiffness matrix, at 212, for the entire drilling tool assembly (wherein the drill bit is generally represented by a single node). Similarly, element mass matrices are constructed by determining the mass of each element (based on material properties, etc.) and are used to construct a mass matrix, at 214, for the entire drilling tool assembly. Additionally, element damping matrices can be constructed (based on experimental data, approximation, or other method) and used to construct a damping matrix, at 216, for the entire drilling tool assembly. Methods for dividing a system into finite elements and constructing corresponding stiffness, mass, and damping matrices are known in the art and thus are not explained in detail here.

Examples of such methods are shown, for example, in "Finite Elements for Analysis and Design" by J. E. Akin (Academic Press, 1994).

The second part 210*b* of the mechanics analysis model 210 of the drilling tool assembly is a mechanics analysis model of the drill bit 210*b* which takes into account details of selected drill bit design. The drill bit mechanics analysis model 210*b* is constructed by creating a mesh of the cutting elements and cones (for a roller cone bit) of the bit, and establishing a coordinate relationship (coordinate system transformation) between the cutting elements and the cones, between the cones and the bit, and between the bit and the tip of the BHA. As previously noted, examples of methods for constructing mechanics analysis models for roller cone drill bits can be found in U.S. patent application Ser. No. 09/524,088, as well as SPE Paper No. 29922, and PCT International Publication Nos. WO 00/12859 and WO 00/12860, noted above.

Because the response of the drilling tool assembly is subject to the constraint within the wellbore, wellbore constraints for the drilling tool assembly are determined, at 222, 224. First, the trajectory of the wall of the wellbore, which constrains the drilling tool assembly and forces it to conform to the wellbore path, is constructed at 220 using wellbore trajectory parameters provided as input at 204. For example, a cubic B-spline method or other interpolation method can be used to approximate wellbore wall coordinates at depths between the depths provided as input data. The wall coordinates are then discretized (or meshed), at 224 and stored. Similarly, an initial wellbore bottom surface geometry, which is either selected or determined, is also be discretized, at 222, and stored. The initial bottom surface of the wellbore may be selected as flat or as any other contour, which can be provided as wellbore input at 204 or 222. Alternatively, the initial bottom surface geometry may be generated or approximated based on the selected bit geometry. For example, the initial bottomhole geometry may be selected from a "library" (i.e., database) containing stored bottomhole geometries resulting from the use of various bits.

In this embodiment, a coordinate mesh size of 1 millimeter is selected for the wellbore surfaces (wall and bottomhole); however, the coordinate mesh size is not intended to be a limitation on the invention. Once meshed and stored, the wellbore wall and bottomhole geometry, together, comprise the initial wellbore constraints within which the drilling tool assembly must operate, thus, within which the drilling tool assembly response must be constrained.

As shown in FIG. 7A–D, once the (two-part) mechanics analysis model for the drilling tool assembly is constructed 210 (using Newton's second law) and the wellbore constraints are specified 222, 224, the mechanics model and constraints can be used to determine the constraint forces on the drilling tool assembly when forced to the wellbore trajectory and bottomhole from its original "stress free" state. In this embodiment, the constraint forces on the drilling tool assembly are determined by first displacing and fixing the nodes of the drilling tool assembly so the centerline of the drilling tool assembly corresponds to the centerline of the wellbore, at 226. Then, the corresponding constraining forces required on each node (to fix it in this position) are calculated at 228 from the fixed nodal displacements using the drilling tool assembly (i.e., system or global) stiffness matrix from 212. Once the "centerline" constraining forces are determined, the hook load is specified, and initial wellbore wall constraints and bottomhole constraints are introduced at 230 along the drilling tool assembly and at the bit (lowest node). The centerline constraints are used as the wellbore wall constraints. The hook load and gravitational force vector are used to determine the WOB.

As previously noted, the hook load is the load measured at the hook from which the drilling tool assembly is suspended. Because the weight of the drilling tool assembly is known, the bottomhole constraint force (i.e., WOB) can be determined as the weight of the drilling tool assembly minus the hook load and the frictional forces and reaction forces of the hole wall on the drilling tool assembly.

Once the initial loading conditions are introduced, the "centerline" constraint forces on all of the nodes are removed, a gravitational force vector is applied, and the static equilibrium position of the assembly within the wellbore is determined by iteratively calculating the static state of the drilling tool assembly 232. Iterations are necessary since the contact points for each iteration may be different. The convergent static equilibrium state is reached and the iteration process ends when the contact points and, hence, contact forces are substantially the same for two successive iterations. Along with the static equilibrium position, the contact points, contact forces, friction forces, and static WOB on the drilling tool assembly are determined. Once the static state of the system is obtained (at 232) it can be used as the staring point (initial condition) 234 for simulation of the dynamic response of the drilling tool assembly drilling earth formation.

As shown in FIG. 7A–D, once input data are provided and the static state of the drilling tool assembly in the wellbore is determined, calculations in the dynamic response simulation loop 240 can be carried out. Briefly summarizing the functions performed in the dynamic response loop 240, the drilling tool assembly drilling earth formation is simulated by "rotating" the top of the drilling tool assembly (and the downhole motor, if used) through an incremental angle (at 242), and then calculating the response of the drilling tool assembly under the previously determined loading conditions 244 to the rotation(s). The constraint loads on the drilling tool assembly resulting from interaction with the wellbore wall during the incremental rotation are iteratively determined (in loop 245) and are used to update the drilling tool assembly constraint loads (i.e., global load vector), at 248, and the response is recalculated under the updated loading condition. The new response is then rechecked to determine if wall constraint loads have changed and, if necessary, wall constraint loads are re-determined, the load vector updated, and a new response calculated. Then the bottomhole constraint loads resulting from bit interaction with the formation during the incremental rotation are evaluated based on the new response (loop 252), the load vector is updated (at 279), and a new response is calculated (at 280). The wall and bottomhole constraint forces are repeatedly updated (in loop 285) until convergence of a dynamic response solution is determined (i.e., changes in the wall constraints and bottomhole constraints for consecutive solutions are determined to be negligible). The entire dynamic simulation loop 240 is then repeated for successive incremental rotations until an end condition of the simulation is reached (at 290) or until simulation is otherwise terminated. A more detailed description of the elements in the simulation loop 240 follows.

Prior to the start of the simulation loop 240, drilling operating parameters 206 are specified. As previously noted, the drilling operating parameters 206 include the rotary table speed, downhole motor speed (if included in the BHA), and the hook load. In this example, the end condition for simulation is also provided at 204, as either the total number of revolutions to be simulated or the total time for the simulation. Additionally, the incremental step desired for calculations should be defined, selected, or otherwise provided. In the embodiment shown, an incremental time step of $\Delta t=10^{-3}$ seconds is selected. However, it should be understood that the incremental time step is not intended to be a limitation on the invention.

Once the static state of the system is known (from 232) and the operational parameters are provided, the dynamic response simulation loop 240 can begin. In the first step of the simulation loop 240, the current time increment is calculated at 241, wherein $t_{i+1}=t_i+\Delta t$. Then, the incremental rotation which occurs during that time increment is calculated, at 242. In this embodiment, the formula used to calculate an incremental rotation angle at time $t_{i+1}$ is $\theta_{i+1}=\theta_i+RPM*\Delta t*60$, wherein RPM is the rotational speed (in RPM) of the rotary table provided as input data (at 204). The calculated incremental rotation angle is applied proximal to the top of the drilling tool assembly (at the node(s) corresponding to the position of the rotary table). If a downhole motor is included in the BHA, the downhole motor incremental rotation is also calculated and applied to the corresponding nodes.

Once the incremental rotation angle and current time are determined, the system's new configuration (nodal positions) under the extant loads and the incremental rotation is calculated (at 244) using mechanics analysis model modified to include the rotational input as an excitation. For example, a direct integration scheme can be used to solve the resulting dynamic equilibrium equations (modified mechanics analysis model) for the drilling tool assembly. The dynamic equilibrium equation (like the mechanics analysis equation) can be derived using Newton's second law of motion, wherein the constructed drilling tool assembly mass, stiffness, and damping matrices along with the calculated static equilibrium load vector can be used to determine the response to the incremental rotation. For the example shown in FIG. 7A–D, it should be understood that at the first time increment t1 the extant loads on the system are the static equilibrium loads (calculated for t0) which include the static state WOB and the constraint loads resulting from drilling tool assembly contact with the wall and bottom of the wellbore.

As the drilling tool assembly is incrementally "rotated", constraint loads acting on the bit may change. For example, points of the drilling tool assembly in contact with the borehole surface prior to rotation may be moved along the surface of the wellbore resulting in friction forces at those points. Similarly, some points of the drilling tool assembly, which were nearly in contact with the borehole surface prior to the incremental rotation, may be brought into contact with the formation as a result of the incremental rotation, resulting in impact forces on the drilling tool assembly at those locations. As shown in FIG. 7A–D, changes in the constraint loads resulting from the incremental rotation of the drilling tool assembly can be accounted for in the wall interaction update loop 245.

In this example, once the system's response (i.e., new configuration) under the current loading conditions is obtained, the positions of the nodes in the new configuration are checked (at 244) in the wall constraint loop 245 to determine whether any nodal displacements fall outside of the bounds (i.e., violate constraint conditions) defined by the wellbore wall. If nodes are found to have moved outside of the wellbore wall, the impact and/or friction forces which would have occurred due to contact with the wellbore wall are approximated for those nodes (at 248) using the impact and/or friction models or parameters provided as input at 208. Then the global load vector for the drilling tool assembly is updated (also shown at 208) to reflect the newly determined constraint loads. Constraint loads to be calculated may be determined to result from impact if, prior to the incremental rotation, the node was not in contact with the wellbore wall. Similarly, the constraint load can be determined to result from frictional drag if the node now in contact with the wellbore wall was also in contact with the wall prior to the incremental rotation. Once the new constraint loads are determined and the global load vector is updated, at 248, the drilling tool assembly response is recalculated (at 244) for the same incremental rotation under the newly updated load vector (as indicated by loop 245). The nodal displacements are then rechecked (at 246) and the wall interaction update loop 245 is repeated until a dynamic response within the wellbore constraints is obtained.

Once a dynamic response conforming to the borehole wall constraints is determined for the incremental rotation, the constraint loads on the drilling tool assembly due to interaction with the bottomhole during the incremental rotation are determined in the bit interaction loop 250. Those skilled in the art will appreciate that any method for modeling drill bit/earth formation interaction during drilling may be used to determine the forces acting on the drill bit during the incremental rotation of the drilling tool assembly. An example of one method is illustrated in the bit interaction loop 250 in FIG. 7A–D.

In the bit interaction loop 250, the mechanics analysis model of the drill bit is subjected to the incremental rotation angle calculated for the lowest node of the drilling tool assembly, and is then moved laterally and vertically to the new position obtained from the same calculation, as shown at 249. As previously noted, the drill bit in this example is a roller cone drill bit. Thus, in this example, once the bit rotation and new bit position are determined, interaction between each cone and the formation is determined. For a first cone, an incremental cone rotation angle is calculated at 252 based on a calculated incremental cone rotation speed and used to determine the movement of the cone during the incremental rotation. It should be understood that the incremental cone rotation speed can be determined from all the forces acting on the cutting elements of the cone and Newton's second law of motion. Alternatively, it may be approximated from the rotation speed of the bit and the effective radius of the "drive row" of the cone. The effective radius is generally related to the lateral extent of the cutting elements that extend the farthest from the axis of rotation of the cone. Thus, the rotation speed of the cone can be defined or calculated based on the calculated bit rotational speed and the defined geometry of the cone provided as input (e.g., the cone diameter profile, cone axial offset, etc.)

Then, for the first cone, interaction between each cutting element and the earth formation is determined in the cutting element/formation interaction loop 256. In this interaction loop 256, the new position of a cutting element, for example, cutting element j on row k, is calculated 258 based on the incremental cone rotation and bit rotation and translation. Then, the location of cutting element j,k relative to the bottomhole and wall of the wellbore is evaluated, at 259, to determine whether cutting element interference (or contact) with the formation occurred during the incremental rotation of the bit. If it is determined that contact did not occur, then the next cutting element is analyzed and the interaction evaluation is repeated for the next cutting element. If contact is determined to have occurred, then a depth of penetration, interference projection area, and scraping distance of the cutting element in the formation are determined, at 262, based on the next movement of the cutting element during the incremental rotation. The depth of penetration is the distance from the earth formation surface a cutting element penetrates into the earth formation. Depth of penetration can range from zero (no penetration) to the full height of the cutting element (full penetration). Interference projection area is the fractional amount of the cutting element surface area, corresponding to the depth of penetration, which actually contacts the earth formation. A fractional amount of contact usually occurs due to craters in the formation formed from previous contact with cutting elements. Scraping distance takes into account the movement of the cutting element in the formation during the incremental rotation. Once the depth of penetration, interference projection area, and scraping distance are determined for cutting element j,k these parameters are used in conjunction with the cutting element/formation interaction data to determine the resulting forces (constraint forces) exerted on the cutting element by the earth formation (also indicated at 262). For example, force may be determined using the relationship disclosed in U.S. patent application Ser. No. 09/524,088, noted above and incorporated herein by reference.

Once the cutting element/formation interaction variables (area, depth, force, etc.) are determined for cutting element j,k, the geometry of the bottom surface of the wellbore can be temporarily updated, at 264, to reflect the removal of formation by cutting element j,k during the incremental rotation of the drill bit. The actual size of the crater resulting from cutting element contact with the formation can be determined from the cutting element/earth formation interaction data based on the bottomhole surface geometry, and the forces exerted by the cutting element. One such procedure is described in U.S. patent application Ser. No. 09/524,088, noted above.

After the bottomhole geometry is temporarily updated, insert wear and strength can also be analyzed, as shown at 270, based on wear models and calculated loads on the cutting elements to determine wear on the cutting elements resulting from contact with the formation and the resulting reduction in cutting element strength. Then, the cutting element/formation interaction loop 260 calculations are repeated for the next cutting element (j=j+1) of row k until cutting element/formation interaction for each cutting element of the row is determined.

Once the forces on each cutting element of a row are determined, the total forces on that row are calculated (at 268) as a sum of all the forces on the cutting elements of that row. Then, the cutting element/earth formation interaction calculations are repeated for the next row on the cone (k=k+1) (in the row interaction loop 269) until the forces on each of the cutting elements on each of the rows on that cone are obtained. Once interaction of all of the cutting elements on a cone is determined, cone shell interaction with the formation is determined by checking node displacements at the cone surface, at 270, to determine if any of the nodes are out of bounds with respect to (or make contact with) the wellbore wall or bottomhole surface. If cone shell contact is determined to have occurred for the cone during the incremental rotation, the contact area and depth of penetration of the cone shell are determined (at 272) and used to determine interaction forces on the cone shell resulting from the contact.

Once forces resulting from cone shell contact with the formation during the incremental rotation are determined, or it is determined that no shell contact has occurred, the total interaction forces on the cone during the incremental rotation can be calculated by summing all of the row forces and any cone shell forces on the cone, at 274. The total forces acting on the cone during the incremental rotation may then be used to calculate the incremental cone rotation speed $\dot{\theta}_l$, at 276. Cone interaction calculations are then repeated for each cone (l=l+1) until the forces, rotation speed, etc. on each of the cones of the bit due to interaction with the formation are determined.

Once the interaction forces on each cone are determined, the total axial force on the bit (dynamic WOB) during the incremental rotation of the drilling tool assembly is calculated 278, from the cone forces. The newly calculated bit interaction forces are then used to update the global load vector (at 279), and the response of the drilling tool assembly is recalculated (at 280) under the updated loading condition. The newly calculated response is then compared to the previous response (at 282) to determine if the responses are substantially similar. If the responses are determined to be substantially similar, then the newly calculated response is considered to have converged to a correct solution. However, if the responses are not determined to be substantially similar, then the bit interaction forces are recalculated based on the latest response at 284 and the global load vector is again updated (as indicated at 284). Then, a new response is calculated by repeating the entire response calculation (including the wellbore wall constraint update and drill bit interaction force update) until consecutive responses are obtained which are determined to be substantially similar (indicated by loop 285), thereby indicating convergence to the solution for dynamic response to the incremental rotation.

Once the dynamic response of the drilling tool assembly to an incremental rotation is obtained from the response force update loop 285, the bottomhole surface geometry is then permanently updated (at 286) to reflect the removal of formation corresponding to the solution. At this point, output information desired from the incremental simulation step can be provided as output or stored. For example, the new position of the drilling tool assembly, the dynamic WOB, cone forces, cutting element forces, impact forces, friction forces, may be provided as output information or stored.

This dynamic response simulation loop 240 as described above is then repeated for successive incremental rotations of the bit until an end condition of the simulation (checked at 290) is satisfied. For example, using the total number of bit revolutions to be simulated as the termination command, the incremental rotation of the drilling tool assembly and subsequent iterative calculations of the dynamic response simulation loop 240 will be repeated until the selected total number of revolutions to be simulated is reached. Repeating the dynamic response simulation loop 240 as described above will result in simulating the performance of an entire drilling tool assembly drilling earth formations with continuous updates of the bottomhole pattern as drilled, thereby simulating the drilling of the drilling tool assembly in the selected earth formation. Upon completion of a selected number of operations of the dynamic response simulation loop, results of the simulation may be used to generate output information at 294 characterizing the performance of the drilling tool assembly drilling the selected earth formation under the selected drilling conditions, as shown in FIG. 7A–D. It should be understood that the simulation can be stopped using any other suitable termination indicator, such as a selected wellbore depth desired to be drilled, indicated divergence of a solution, etc.

Figure 12:
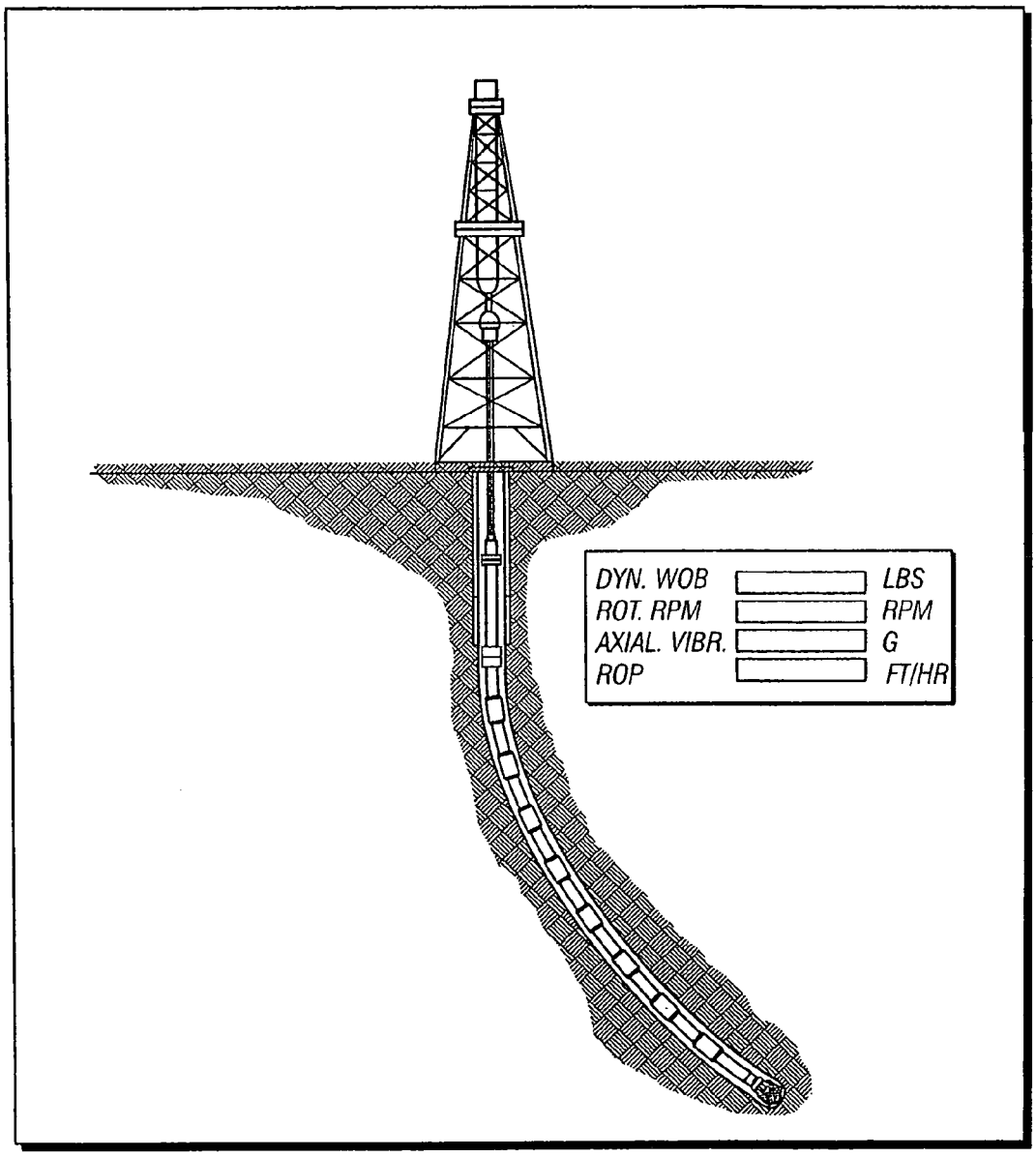
FIG. 12 shows one example of output data converted into a visual representation.

As noted above, output information from a dynamic simulation of a drilling tool assembly drilling an earth formation may include, for example, the drilling tool assembly configuration (or response) obtained for each time increment, and corresponding bit forces, cone forces, cutting element forces, impact forces, friction forces, dynamic WOB, resulting bottomhole geometry, etc. This output information may be presented in the form of a visual representation (indicated at 294), such as a visual representation of the borehole being drilled through the earth formation with continuous updated bottomhole geometries and the dynamic response of the drilling tool assembly to drilling presented on a computer screen. Alternatively, the visual representation may include graphs of parameters provided as input and/or calculated during the simulation. For example, a time history of the dynamic WOB or the wear of cutting elements during drilling may be presented as a graphic display on a computer screen. It should be understood that the invention is not limited to any particular type of display. Further, the means used for visually displaying aspects of simulated drilling is a matter of convenience for the system designer, and is not intended to limit the invention. One example of output data converted to a visual representation is illustrated in FIG. 12, wherein the rotation of the drilling tool assembly and corresponding drilling of the formation is graphically illustrated as a visual display of drilling and desired parameters calculated during drilling can be numerically displayed.

The example described above represents only one embodiment of the invention. Those skilled in the art will appreciate that other embodiments can be devised which do not depart from the scope of the invention as disclosed herein. For example, an alternative method can be used to account for changes in constraint forces during incremental rotation. For example, instead of using a finite element method, a finite difference method or a weighted residual method can be used to model the drilling tool assembly. Similarly, other methods may be used to predict the forces exerted on the bit as a result of bit/cutting element interaction with the bottomhole surface. For example, in one case, a method for interpolating between calculated values of constraint forces may be used to predict the constraint forces on the drilling tool assembly or a different method of predicting the value of the constraint forces resulting from impact or frictional contact may be used. Further, a modified version of the method described above for predicting forces resulting from cutting element interaction with the bottomhole surface may be used. These methods can be analytical, numerical (such as finite element method), or experimental. Alternatively, methods such as disclosed in SPE Paper No. 29922 noted above or PCT Patent Application Nos. WO 00/12859 and WO 00/12860 may be used to model roller cone drill bit interaction with the bottomhole surface, or methods such as disclosed in SPE papers no. 15617 and no. 15618 noted above may be used to model fixed-cutter bit interaction with the bottomhole surface if a fixed-cutter bit is used.

Method for Designing a Drilling Tool Assembly

In another aspect, the invention provides a method for designing a drilling tool assembly for drilling earth formations. For example, the method may include simulating a dynamic response of a drilling tool assembly, adjusting the value of at least one drilling tool assembly design parameter, repeating the simulating, and repeating the adjusting and the simulating until a value of at least one drilling performance parameter is determined to be an optimal value.

Methods in accordance with this aspect of the invention may be used to analyze relationships between drilling tool assembly design parameters and drilling performance of a drilling tool assembly. This method also may be used to design a drilling tool assembly having enhanced drilling characteristics. Further, the method may be used to analyze the effect of changes in a drilling tool configuration on drilling performance. Additionally, the method may enable a drilling tool assembly designer or operator to determine an optimal value of a drilling tool assembly design parameter for drilling at a particular depth or in a particular formation.

Examples of drilling tool assembly design parameters include the type and number of components included in the drilling tool assembly; the length, ID, OD, weight, and material properties of each component; and the type, size, weight, configuration, and material properties of the drill bit; and the type, size, number, location, orientation, and material properties of the cutting elements on the bit. Material properties in designing a drilling tool assembly may include, for example, the strength, elasticity, and density of the material. It should be understood that drilling tool assembly design parameters may include any other configuration or material parameter of the drilling tool assembly without departing from the spirit of the invention.

Examples of drilling performance parameters include rate of penetration (ROP), rotary torque required to turn the drilling tool assembly, rotary speed at which the drilling tool assembly is turned, drilling tool assembly vibrations induced during drilling (e.g., lateral and axial vibrations), weight on bit (WOB), and forces acting on the bit, cones, and cutting elements. Drilling performance parameters may also include the inclination angle and azimuth direction of the borehole being drilled. One skilled in the art will appreciate that other drilling performance parameters exist and may be considered as determined by the drilling tool assembly designer without departing from the spirit of the invention.

Figure 8:
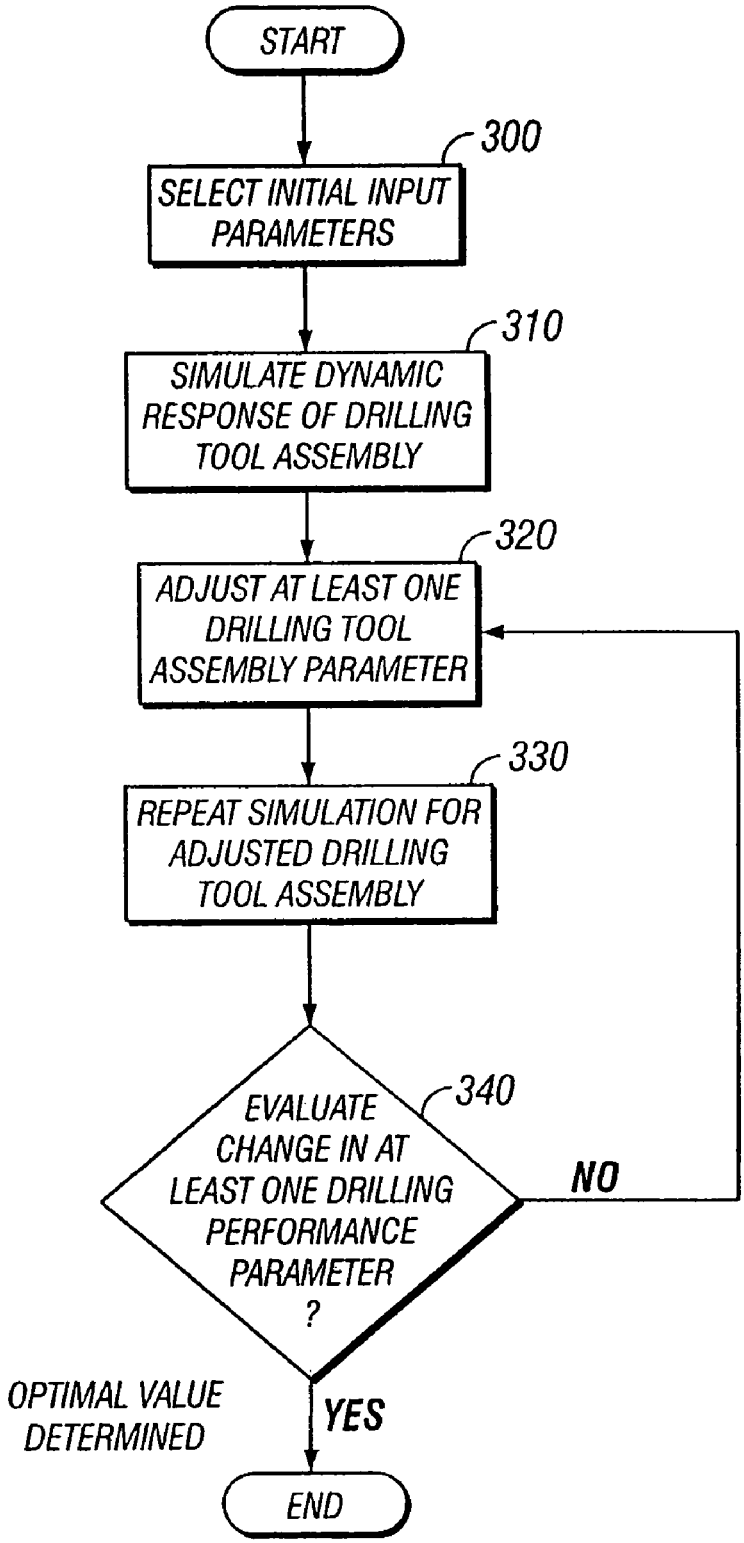
FIG. 8 shows a general flow chart of one method for determining an optimal value of at least one drilling tool assembly design parameter.

In one application of this aspect of the invention, illustrated in FIG. 8, the method comprises defining, selecting or otherwise providing initial input parameters at 300 (including drilling tool assembly design parameters). The method further comprises simulating the dynamic response of the drilling tool assembly at 310, adjusting at least one drilling tool assembly design parameter at 320, and repeating the simulating of the drilling tool assembly 330. The method also comprises evaluating the change in value of at least one drilling performance parameter 340, and based on that evaluation, repeating the adjusting, the simulating, and the evaluating until at least one drilling performance parameter is optimized.

Figure 9:
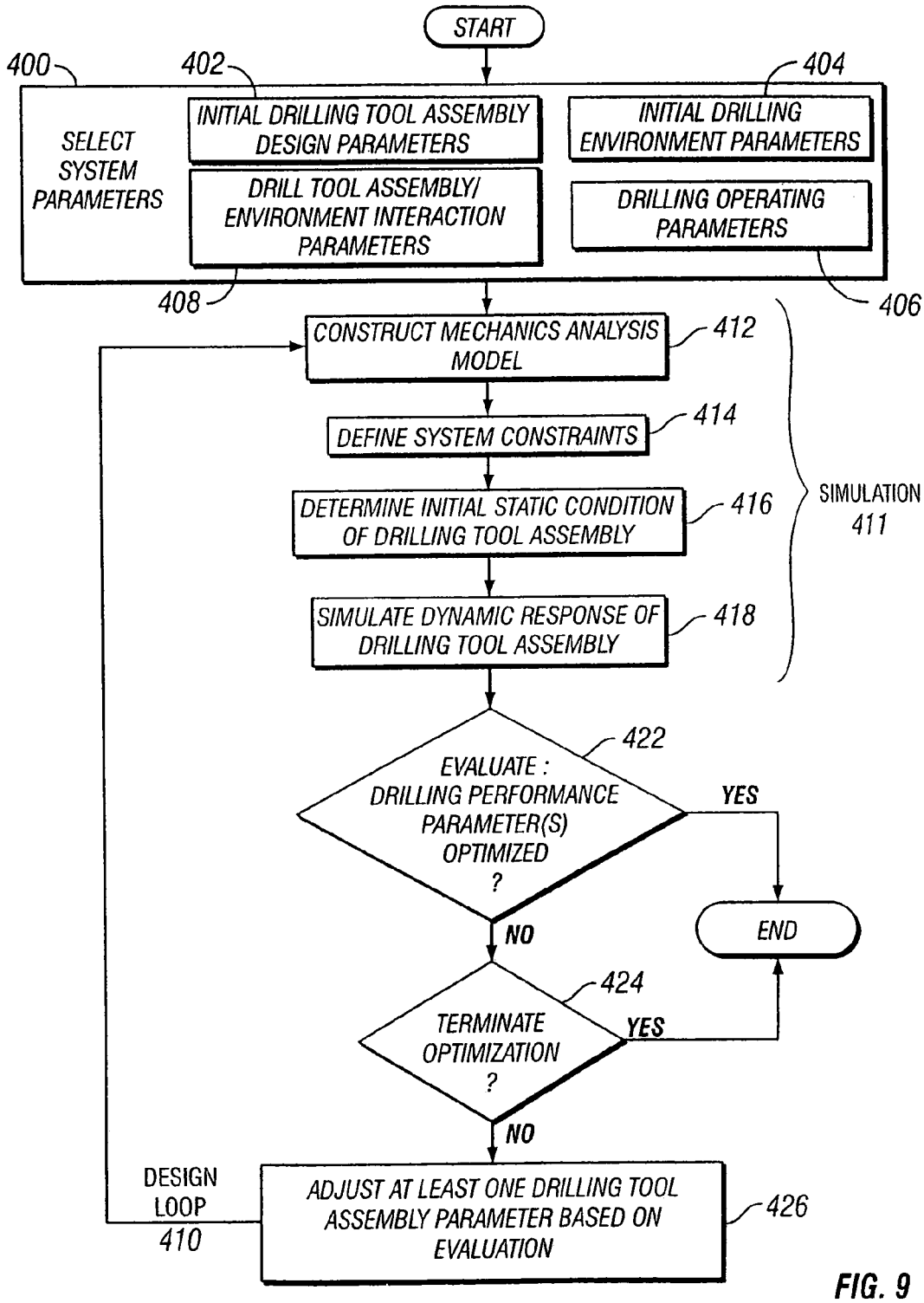
FIG. 9 shows a more detailed flow chart of a method for determining an optimal value of at least one drilling tool assembly design parameter.

As shown in the more detailed example of FIG. 9, the initial parameters 400 may include initial drilling tool assembly parameters 402, initial drilling environment parameters 404, drilling operating parameters 406, and drilling tool assembly/drilling environment interaction parameters and/or models 408. These parameters may be substantially the same as the input parameters described above for the previous aspect.

In this example, simulating 411 comprises constructing a mechanics analysis model of the drilling tool assembly (at 412) based on the drilling tool assembly parameters 402, determining system constraints at 414 using the drilling environment parameters 404, and then using the mechanics analysis model along with the system constraints to solve for the initial static state of the drilling tool assembly in the drilling environment (at 416). Simulating 411 further comprises using the mechanics analysis model along with the constraints and drilling operation parameters 406 to incrementally solve for the response of the drilling tool assembly to rotational input from a rotary table (at 418) and/or downhole motor, if used. In solving for the dynamic response, the response is obtained for successive incremental rotations until an end condition signaling the end of the simulation is detected.

Incrementally solving for the response may also include determining, from drilling tool assembly/environment interaction information, loads on the drilling tool assembly during the incremental rotation resulting from changes in interaction between the drilling tool assembly and the drilling environment during the incremental rotation, and then recalculating the response of the drilling tool assembly under the new constraint loads. Incrementally solving may further include repeating, if necessary, the determining loads and the recalculating of the response until a solution convergence criterion is satisfied.

Examples for constructing a mechanics analysis model, determining initial system constraints, determining the initial static state, and incrementally solving for the dynamic response of the drilling tool assembly are described in detail for the previous aspect of the invention.

In the present example shown in FIG. 9, adjusting at least one drilling tool assembly design parameter 426 comprises changing a value of at least one drilling tool assembly design parameter after each simulation by data input from a file, data input from an operator, or based on calculated adjustment factors in a simulation program, for example.

Drilling tool assembly design parameters may include any of the drilling tool assembly parameters noted above. Thus in one example, a design parameter, such as the length of a drill collar, can be repeatedly adjusted and simulated to determine the effects of BHA weight and length on a drilling performance parameter (e.g., ROP). Similarly, the inner diameter or outer diameter of a drilling collar may be repeatedly adjusted and a corresponding change response obtained. Similarly, a stabilizer or other component can be added to the BHA or deleted from the BHA and a corresponding change in response obtained. Further, a bit design parameter may be repeatedly adjusted and corresponding dynamic responses obtained to determine the effect of changing one or more drill bit design parameters, such as cone profile, insert shape and size, number of rows offsets (for roller cone bits) on the drilling performance of the drilling tool assembly.

In the example of FIG. 9, repeating the simulating 411 for the "adjusted" drilling tool assembly comprises constructing a new (or adjusted) mechanics analysis model (at 412) for the adjusted drilling tool assembly, determining new system constraints (at 414), and then using the adjusted mechanics analysis model along with the corresponding system constraints to solve for the initial static state (at 416) of the of the adjusted drilling tool assembly in the drilling environment. Repeating the simulating 411 further comprises using the mechanics analysis model, initial conditions, and constraints to incrementally solve for the response of the adjusted drilling tool assembly to simulated rotational input from a rotary table and/or a downhole motor, if used.

Once the response of the previous assembly design and the response of the current assembly design are obtained, the effect of the change in value of at least one design parameter on at least one drilling performance parameter can be evaluated (at 422). For example, during each simulation, values of desired drilling performance parameters (WOB, ROP, impact loads, etc.) can be calculated and stored. Then, these values or other factors related to the drilling response (such as vibration factors), can be analyzed to determine the effect of adjusting the drilling tool assembly design parameter on the value of the at least one drilling performance parameter.

Once an evaluation of at least one drilling parameter is made, based on that evaluation the adjusting and the simulating may be repeated until it is determined that the at least one drilling performance parameter is optimized or an end condition for optimization has been reached (at 424). A drilling performance parameter may be determined to be at an optimal value when a maximum rate of penetration, a minimum rotary torque for a given rotation speed, and/or most even weight on bit is determine for a set of adjustment variables. Other drilling performance parameters, such as minimized lateral impact force or optimized/balanced forces on different cones for roller cone bit applications can also be used. A simplified example of repeating the adjusting and the simulating based on evaluation of consecutive responses is as follows.

Assume that the BHA weight is the drilling tool assembly design parameter to be adjusted (for example, by changing the length, equivalent ID, OD, adding or deleting components), and ROP is the drilling performance parameter to be optimized. Therefore, after obtaining a first response for a given drilling tool assembly configuration, the weight of the BHA can be increased and a second response can be obtained for the adjusted drilling tool assembly. The weight of the BHA can be increased, for example, by changing the ID for a given OD of a collar in the BHA (will ultimately affect the system mass matrix). Alternatively, the weight of the BHA can be increased by increasing the length, OD, or by adding a new collar to the BHA (will ultimately affect the system stiffness matrix). In either case, changes to the drilling tool assembly will effect the mechanics analysis model for the system and the resulting initial conditions. Therefore, the mechanics analysis model and initial conditions will have to be re-determined for the new configuration before a solution for the second response can be obtained. Once the second response is obtained, the two responses (one for the old configuration, one for the new configuration) can be compared to determine which configuration (BHA weight) resulted in the most favorable (or greater) ROP. If the second configuration is found to result in a greater ROP, then the weight of the BHA may be further increased, and a (third) response for the newer configuration) may be obtained and compared to the second. Alternatively, if the increase in the weight of the BHA is found to result in a decrease in the ROP, then the drilling tool assembly design may be readjusted to decrease the BHA weight to a value lower than that set for the first drilling tool assembly configuration and a (third) response may be obtained and compared to the first. This adjustment, recalculation, evaluation may be repeated until it is determined that an optimal or desired value of at least one drilling performance parameter, such as ROP in this case, is obtained.

Advantageously, embodiments of the invention may be used to analyze the relationship between drilling tool assembly design parameters and drilling performance in a selected drilling environment. Additionally, embodiments of the invention may be used to design a drilling tool assembly having optimal drilling performance for a given set of drilling conditions. Those skilled in the art will appreciate that other embodiments of the invention exist which do not depart from the spirit of this aspect of the invention.

Method for Optimizing Drilling Operating Parameters for a Selected or Particular Drilling Tool Assembly In another aspect, the invention provides a method for determining optimal drilling operating parameters for a selected drilling tool assembly. In one embodiment, this method includes simulating a dynamic response of a drilling tool assembly, adjusting the value of at least one drilling operating parameters, repeating the simulating, and repeating the adjusting and the simulating until a value of at least one drilling performance parameter is determined to be an optimal value.

The method in accordance with this aspect of the invention may be used to analyze relationships between drilling operating parameters and the drilling performance of a selected drilling tool assembly. The method also may be used to improve the drilling performance of a selected drilling tool assembly. Further, the method may be used to analyze the effect of changes in drilling operating parameters on the drilling performance of the selected drilling tool assembly. Additionally, the method in accordance with this aspect of the invention may enable the drilling tool assembly designer or operator to determine optimal drilling operating parameters for a selected drilling tool assembly drilling a particular depth or in a particular formation.

As previously explained, drilling operating parameters include, for example, rotational speed at which the drilling tool assembly is turned, or rotary torque applied to turn the drilling tool assembly, hook load (which is one of the major factors to influence WOB), drilling fluid flow rate, and material properties of the drilling fluid (e.g., viscosity, density, etc.). It should be understood that drilling parameters may include any drilling environment or drilling operating parameters which may affect the drilling performance of a drilling tool assembly without departing from the spirit of the invention.

Drilling performance parameters that may be considered in optimizing the design of a drilling tool assembly may include, for example, the ROP, rotary torque required to turn the drilling tool assembly, rotary speed at which the drilling tool assembly is turned, drilling tool assembly vibrations (in terms of velocities, accelerations, etc.), WOB, lateral force, moments, etc. on the bit, lateral and axial forces, moments, etc. on the cones, and lateral and axial forces on the cutting elements. It should be understood that during simulation velocity and displacement are calculated for each node point and can be used to calculate force/acceleration as an indicator of drilling tool assembly vibrations. One skilled in the art will appreciate that other parameters which can be used to evaluate drilling performance exist and may be used as determined by the drilling tool assembly designer without departing from the spirit of the invention.

Figure 10:
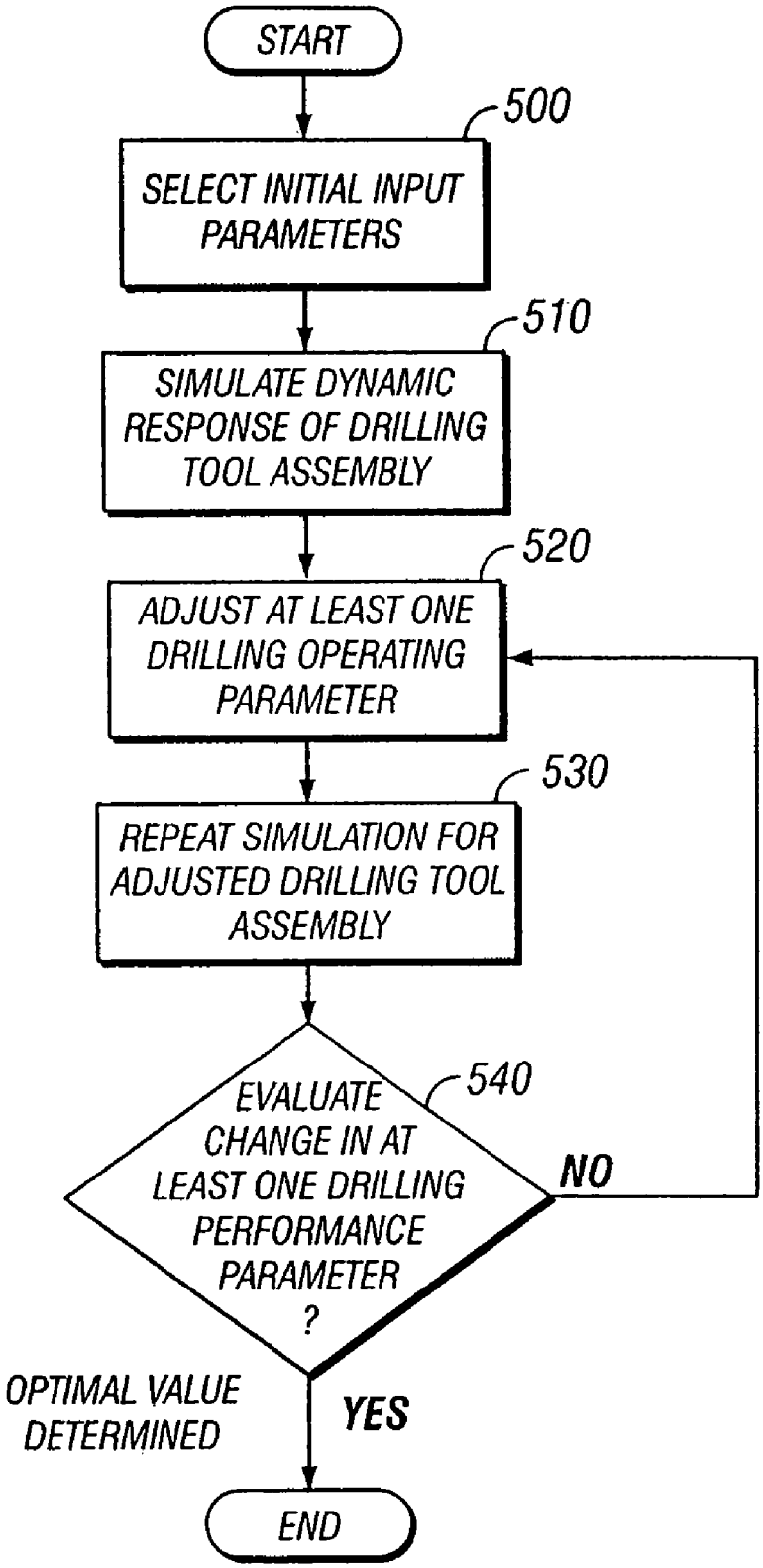
FIG. 10 shows a general flow chart of one method for determining an optimal value for at least one drilling operating parameter for a drilling tool assembly.

FIG. 10 shows a flow chart for one example of a method for determining at least one optimal drilling operating parameter for a selected drilling tool assembly. In this example, the method comprises defining, selecting or otherwise providing initial input parameters at 500 (including drilling tool assembly design parameters and drilling operating parameter) which describe various aspects of the initial system. The method further comprises simulating the dynamic response of a drilling tool assembly at 510, adjusting at least one drilling operating parameter at 520, and repeating the simulating of the drilling tool assembly at 530. The method also comprises evaluating the change in value of at least one drilling performance parameter 540, and based on that evaluation, repeating the adjusting 520, the simulating 530, and the evaluating 540 until at least one drilling performance parameter is optimized.

Figure 11:
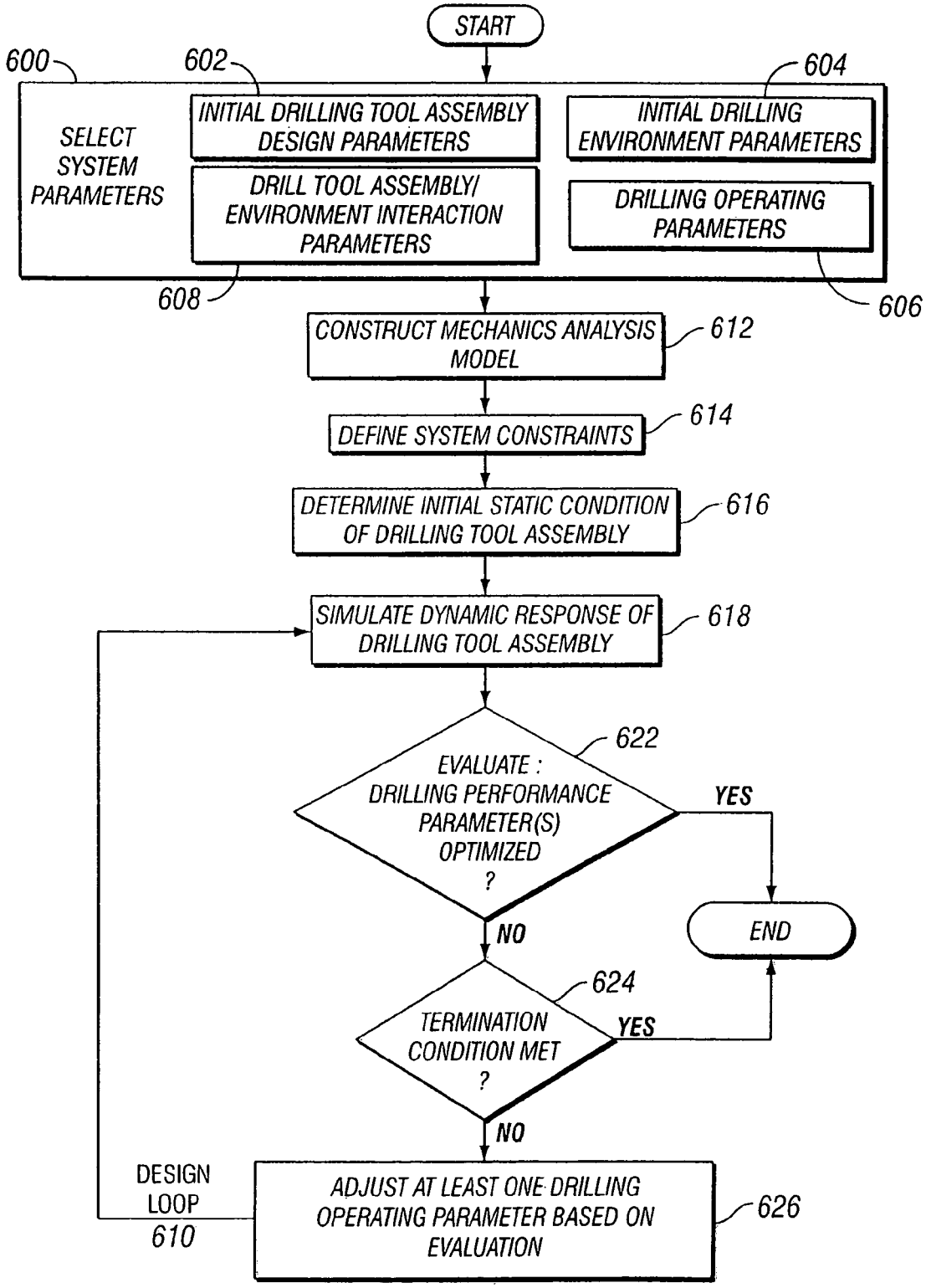
FIG. 11 shows a more detailed flow chart of a method for determining an optimal value for at least one drilling operating parameter for a drilling tool assembly.

Another example of such a method is shown in FIG. 11. In this example, the initial parameters 600 include initial drilling tool assembly parameters 602, initial drilling environment parameters 604, initial drilling operating parameters 606, and drilling tool assembly/drilling environment interaction parameters and/or models 608. These parameters may be substantially the same as those described for the first aspect of the invention discussed above.

In this example, once the input parameters 600 are provided, the input parameters 600 are used to construct a mechanics analysis model (at 612) of the drilling tool assembly and used to determine system constraints (at 614) (wellbore wall and bottom surface constraints). Then, the mechanics analysis model and system constraints are used to determine the initial conditions (at 616) on the drilling tool assembly inserted in the wellbore. Examples for constructing a mechanics analysis model of a drilling tool assembly and determining initial constraints and initial conditions are described in detail above for the first aspect of the invention.

In the example shown in FIG. 11, simulating the dynamic response 611 comprises using the mechanics analysis model along with the initial constraints and initial conditions to incrementally solve for the dynamic response of the drilling tool assembly to simulated rotational input from a rotary table (at 618) and/or downhole motor. The dynamic response to successive incremental rotations is incrementally obtained until an end condition signaling the end of the simulation is detected.

Incrementally solving for the response may include iteratively determining, from drilling tool assembly/environment interaction data or models, new drilling environment interaction forces on the drilling tool assembly resulting from changes in interaction between the drilling tool assembly and the drilling environment during the incremental rotation, and then recalculating the response of the drilling tool assembly to the incremental rotation under the newly calculated constraint loads. Incrementally solving may further include repeating, if necessary, the determining and the recalculating until a constraint load convergence criterion is satisfied. An example of incrementally solving for the response as described here is presented in detail for the first aspect of the invention.

At least one drilling operating parameter may be adjusted (at 620) as discussed above for the previous aspect of the invention, such as by reading in a new value from a data file, data input from an operator, or calculating adjustment values based on evaluation of responses corresponding to previous values, for example. Similarly, drilling performance parameter(s) adjusted may be any parameter effecting the operation of drilling without departing from the spirit of the invention. In some cases, adjusted drilling parameters may be limited to only particular parameters. For example, the drilling tool assembly designer/operator may concentrate only on the effect of the rotary speed and hook load (or WOB) on drilling performance, in which case only parameters effecting the rotary speed or hook load (or WOB) may be adjustable.

In the example shown in FIG. 11, repeating the simulating 618 comprises at least recalculating the response of the drilling tool assembly to the adjusted drilling operating conditions. However, if an adjustment is made to a drilling operating parameter that affects the drilling environment, such as the viscosity or density of drilling fluid, repeating the simulation may comprise first determining a new system global damping matrix and global load vectors and then using the newly updated mechanics analysis model to incrementally solve for the response of the drilling tool assembly to simulated rotation under the new drilling operating conditions. However, if the adjustment made to a drilling operating parameters does not affect the drilling environment, which may typically be the case (e.g., rotation speed of the rotary table), repeating the simulation may only comprise solving for the dynamic response of the drilling tool assembly to the adjusted operating conditions and the same initial conditions (the static equilibrium state) by using the mechanics analysis model.

Similar to the previous aspect, once a response for the previous adjusted operating parameters and a response for the current adjusted operating parameters are obtained, the effect the change in value of the drilling operating parameter on drilling performance can be evaluated (at 622). For example, during each simulation values of desired drilling performance parameters (WOB, ROP, impact loads, optimized force distribution on cutting elements, optimized/balanced for distribution on cones for roller cone bits, optimized force distribution on lades for PDC bits, etc.) can be calculated. Then, these values or other factors related to the response (such as vibration parameters) can be analyzed to determine the effect of adjusting the drilling operating parameter on the value of at least one drilling performance parameter.

Optimization criteria may include optimizing the force distribution on cutting elements, maximizing the rate of penetration (ROP), minimizing the WOB required to obtain a given ROP, minimizing lateral impact force, etc. In addition, for roller cone drill bits, optimization criteria may also include optimizing or balancing force distribution on cones. For fixed-cutter bits, such as PDC bits, optimization criteria may also include optimizing force distribution on the blades or among the blades.

Once an evaluation of the least one drilling operating parameter is made, based on that evaluation the adjusting and the simulating may be repeated until it is determined that at least one drilling performance parameter is optimized, or until an end condition for optimization is reached. As noted for the previous aspect, a drilling performance parameter may be determined to be at an optimal value when, for example, a maximum rate of penetration, a minimum rotary torque for a given rotation speed, and/or most even weight on bit is determine for a set of adjustment variables. Additionally, an end condition for optimization may include determining when a change in the operation value no long results in an improvement in the drilling performance of the drilling tool assembly. A simplified example of repeating the adjusting, the simulating, and the evaluating until a drilling performance parameter is optimized is as follows.

For example, if after obtaining a first response, the hook load is decreased (which ultimately increases the WOB), and then a second response is obtained for the decreased hook load, the ROP of the two responses can be compared. If the second response is found to have a greater ROP than the first (i.e., decreased hook load is shown to increase ROP), the hook load may be further decrease and a third response may be obtained and compared to the second. This adjustment, resimulation, evaluation may be repeated until the point at which decrease in hook load provides maximum ROP is obtained. Alternatively, if the decrease in hook load is found to result in an decrease in the ROP, then the hook load may be increased to value higher than the value of the hook load for the first simulation, and a third response may be obtained and compared with the first (having the more favorable ROP). This adjustment, resimulation, evaluation may be repeated until it is determined that further increase in hook load provides no further benefit in the ROP.

Advantageously, embodiments of the invention may be used to analyze the relationship between drilling parameters and drilling performance for a select drilling tool assembly drilling a particular earth formation. Additionally, embodiments of the invention may be used to optimize the drilling performance of a given drilling tool assembly. Those skilled in the art will appreciate that other embodiments of the invention exist which do not depart from the spirit of this aspect of the invention.

Further, it should be understood that regardless of the complexity of a drilling tool assembly or the trajectory of the wellbore in which it is to be constrained, the invention provides reliable methods that can be used for predicting the dynamic response of the drilling tool assembly drilling an earth formation. The invention also facilitates designing a drilling tool assembly having enhanced drilling performance, and helps determine optimal drilling operating parameters for improving the drilling performance of a selected drilling tool assembly.

While the invention has been described with respect to a limited number of embodiments and examples, those skilled in the art will appreciate that other embodiments can be devised which do not depart from the scope of the invention as disclosed herein. Accordingly, the scope of the invention should be limited only by the attached claims.

What is claimed is:

1. A method for simulating a drilling tool assembly having a drill string and a drill bit, comprising:

simulating a dynamic response of the drill string;

simulating a dynamic response of the drill bit; and resolving the dynamic response of the drill string and the dynamic response of the drill bit into a dynamic response of the drilling tool assembly.

2. The method of claim 1, wherein the simulating comprises, solving for the dynamic response of the drill string to an incremental rotation using a first part of a two-part mechanics analysis model of the drilling tool assembly that represents the drill string; and repeating said solving for a select number of successive incremental rotations.

3. The method of claim 1, wherein the simulating comprises, solving for the dynamic response of the drill string to an incremental rotation using a second part of a two-part mechanics analysis model of the drilling tool assembly that represents the drill bit; and repeating said solving for a select number of successive incremental rotations.

4. The method of claims 2 or 3, wherein said solving comprises, constructing the two-part mechanics analysis model of the drilling tool assembly using selected drilling tool assembly design parameters;

determining well bore constraints from well bore trajectory parameters, a specified bottom hole geometry, and a specified hook load, determining loads on the drilling tool assembly for a position of the drilling tool assembly in the well bore using at least the two-part mechanics analysis model and the well bore constraints; and calculating the dynamic response of the drilling tool assembly under the loads to the incremental rotation using the two-part mechanics analysis model.

5. The method of claim 1, wherein said resolving comprises, applying a convergence algorithm to said simulating the dynamic response of the drill string and said simulating the dynamic response of the drill bit.

6. A new method of claim 1, further comprising:

converting the dynamic response of the drilling tool assembly into a visual presentation of drilling characteristics of the drilling tool assembly.

7. A method for designing a drill string of a drilling tool assembly, comprising:

defining initial drilling tool assembly design parameters;

simulating a dynamic response of the drill string of the drilling tool assembly;

simulating a dynamic response of a drill bit of the drilling tool assembly;

resolving the dynamic response of the drill string and the dynamic response of the drill bit into a dynamic response of the drilling tool assembly;

adjusting a value of at least one of the drill string design parameters;

repeating the simulating and the adjusting a selected number of times;

evaluating the dynamic responses of the drilling tool assembly; and based on the evaluating, selecting desired drill string design parameters.

8. A method for designing a drill string of a drilling tool assembly, comprising:

defining initial drilling tool assembly design parameters;

simulating a dynamic response of the drill bit of the drilling tool assembly;

simulating a dynamic response of a drill string of the drilling tool assembly;

resolving the dynamic response of the drill string and the dynamic response of the drill bit into a dynamic response of the drilling tool assembly;

adjusting a value of at least one of the drill bit design parameters;

repeating the simulating and the adjusting a selected number of times;

evaluating the dynamic responses of the drilling tool assembly; and based on the evaluating, selecting desired drill bit design parameters.

* * * * *